US006708636B1

(12) United States Patent
Hagner

(10) Patent No.: US 6,708,636 B1
(45) Date of Patent: Mar. 23, 2004

(54) REBUILT DOUBLE HULL TANKER AND METHOD OF REBUILDING AN EXISTING SINGLE HULL TANKER INTO A REBUILT DOUBLE HULL TANKER

(75) Inventor: Thomas R. Hagner, Riverview, FL (US)

(73) Assignee: Maritrans Inc., Tampa, FL (US)

( * ) Notice: Subject to any disclaimer, the term of this patent is extended or adjusted under 35 U.S.C. 154(b) by 0 days.

(21) Appl. No.: 10/371,832

(22) Filed: Feb. 21, 2003

Related U.S. Application Data

(60) Provisional application No. 60/394,577, filed on Jul. 9, 2002.

(51) Int. Cl.[7] ..... B63B 25/12

(52) U.S. Cl. ..... 114/74 A; 114/65 R

(58) Field of Search ..... 114/65 R, 74 R, 114/747

(56) References Cited

U.S. PATENT DOCUMENTS

| | | | | |
|---|---|---|---|---|
| 5,189,975 A | | 3/1993 | Zednik et al. | 114/74 |
| 5,218,919 A | | 6/1993 | Krulikowski, III et al. | 114/74 |
| 5,899,162 A | * | 5/1999 | Beaupre et al. | 114/74 A |
| 6,009,821 A | * | 1/2000 | Al-Rammah et al. | 114/65 A |
| 6,170,420 B1 | | 1/2001 | Hagner et al. | 114/65 |
| 6,357,373 B1 | | 3/2002 | Hagner et al. | 114/65 |

FOREIGN PATENT DOCUMENTS

| | | |
|---|---|---|
| JP | 61-24685 | 2/1986 |
| JP | 61-24686 | 2/1986 |

* cited by examiner

*Primary Examiner*—Sherman Basinger
(74) *Attorney, Agent, or Firm*—Woodcock Washburn LLP

(57) ABSTRACT

The present invention relates to a rebuilt double hull tanker and a method of rebuilding an existing single hull tanker into a rebuilt double hull tanker. The rebuilt double hull tanker includes a rebuilt double hull comprising a new double bottom hull and new double side hulls. The internally rebuilt double bottom hull includes the existing outer bottom hull and a new inner bottom hull that is disposed internal and spaced apart from the existing outer bottom hull. The externally rebuilt double side hulls (e.g., port and starboard) include the existing inner side hulls and new outer side hulls disposed external and spaced apart from the existing inner side hull. The rebuilt double bottom hull is connected at each end (e.g., at the turn of the bilge) to the rebuilt double side hulls. The method includes forming the new double hull, including a new double bottom hull and new double side hulls, over at least the cargo carrying portion of the tanker by installing the new inner bottom hull internally over the existing outer bottom hull through access holes cut into the sides of the tanker and installing the new double side hulls externally over the existing inner side hulls.

44 Claims, 22 Drawing Sheets

MODIFIED MIDSHIP

MODIFIED BULKHEAD

OUTBOARD PROFILE

PLAN VIEW

FORWARD WEB FRAME

REBUILT DOUBLE HULL TANKER AND METHOD OF REBUILDING AN EXISTING SINGLE HULL TANKER INTO A REBUILT DOUBLE HULL TANKER

CLAIM OF PRIORITY

This application claims benefit under 35 U.S.C. §119(e) to Provisional Application No. 60/394,577 filed on Jul. 9, 2002.

FIELD OF THE INVENTION

The invention relates generally to the field of seagoing tank vessels, and in particular, to a rebuilt double hull tanker and a method of rebuilding an existing single hull tanker into a rebuilt double hull tanker.

BACKGROUND OF THE INVENTION

The shipping and cargo moving industry is continually faced with customer demand for new and improved tank vessel designs and for new and improved methods of modifying the design of existing tank vessels. Substantial cost savings can be realized by a vessel owner in modifying or rebuilding existing tank vessels to incorporate improvements in tank vessel designs or otherwise extend the life of the tank vessel rather than paying the cost of buliding a new tank vessel.

In addition, new governmental and environmental regulations place certain restrictions and requirements on tank vessel owners and operators. These new or required designs must be capable of securely holding a cargo and also of being seaworthy. At the same time, a tank vessel must comply with shipping and environmental requirements and regulations.

Conventional tankers comprise a tank vessel having a single hull design. This type of hull construction provides a single outer hull or skin that provides structural integrity and acts as a boundary between the operating environment of the tanker (e.g., the sea) and the cargo and internal structure of the tanker. The single hull typically includes a shell having a bottom, a port side, a starboard side, a bow, a stem, and a plurality of bulkheads and internal stiffening frames that support and strengthen the shell of the hull.

Tankers are vessels specially designed to carry liquid or fluid-type cargoes, such as petroleum or chemical products. A problem unique to single hull tankers is that damage to the tanker's hull may lead to rupture of the tanker's cargo tanks and thus spill or leakage of the cargo. This results not only in the loss of cargo, but also in pollution of the marine environment and accompanying coastline.

As a result of the recent heightened environmental awareness and several shipping mishaps, new governmental regulations have been implemented requiring the use of double hulls on designated tank vessels in U.S. waters out to the 200 mile economic zone limit. These double hull requirements are contained in the Oil Pollution Act of 1990 (OPA-90) and have been incorporated in U.S. Coast Guard regulations. In part, OPA-90 requires that all new tank vessels constructed under contracts awarded after 1990 must have double hulls and that all existing single hull tank vessels engaged in the marine transport of oil and petroleum products be rebuilt with double hulls or be retired between the years 1995 and 2015, depending on the size and age of the tanker. The U.S. rules closely parallel those of the International Maritime Organization, which rules apply worldwide.

This has created a great burden on carriers having existing single hull tankers. These single hull tankers will either have to be rebuilt to incorporate a double hull design at great cost to the carrier, or the tankers will have to be retired, in many cases years before the end of their economically useful life.

Double hull designs have been used in the construction of newer tankers in an effort to comply with the requirements of the OPA-90. These double hull vessels typically have an outer hull and an inner hull. The outer hull and the inner hull each have shell plating that forms the structural integrity of the hull. A combination of transverse and longitudinal framing is provided between the inner and the outer hull to help strengthen the shell plating.

The idea behind a double hull is that the structural integrity of the outer hull may be breached without breaching the inner hull. Therefore, the outer hull may be breached, i.e., opened to the sea, while the cargo would remain securely contained within the inner hull. Thereby, a potential cargo spill will have been avoided. Typical cargos that have spilled in the past to cause environmental mishaps include cargos such as oil, petroleum, chemical, or other hazardous materials. Of course the provision of a double hull adds to the complexity and cost of new construction.

U.S. Pat. No. 5,218,919, entitled "METHOD AND DEVICE FOR THE INSTALLATION OF DOUBLE HULL PROTECTION," issued on Jun. 15, 1993 to Krulikowski et al. describes the construction of an auxiliary hull, exterior to the primary hull of a ship, which has the capacity to absorb impact energy preventing primary hull puncture, which may be retrofitted to existing single hull ships. However, this external fitting of a new auxiliary hull outside the entirety of the existing single hull to form a double hull is costly and significantly changes the operational characteristics of the vessel. Installing a new auxiliary hull over the existing bottom hull also affects the draft and lowers the baseline of the tanker, significantly affecting flow into the propeller. Also, this design does not meet OPA-90 requirements for minimum hull spacing.

U.S. Pat. No. 5,189,975, entitled "Method for Reconfiguration Tankers," issued Mar. 2, 1993 to Zednik et al. describes a method for converting a single hull tanker to a mid-deck configuration. As disclosed by Zednik et al., the mid-ship cargo section of the tanker is cut longitudinally along a horizontal plane well below the normal laden waterline. A spacer member including a new transverse mid-deck is interposed between the lower and upper portions of the mid-ship cargo section. A tank vessel having a mid-deck configurations are comprised of vertical cargo tanks (one above the other) and double sides, but do not include double bottoms and therefore are not as effective as double hulls, and do not meet OPA-90 requirements (e.g., this type of construction in the U.S. does not constitute a double hull and is considered to be a single hull).

Japanese patent JP 361024685 A, entitled "Method of Reconstructing Existing Tanker into Double Hull Tanker," and Japanese patent 61-24686 both show a method of reconstructing an existing tanker into a double hull tanker wherein a new inner hull and new inner side hulls are installed inside the existing outer plating. However, this method decreases the cargo carrying capability while at the same time also increases the draft of the vessel due to the increased weight of the double hull, both of which are undesirable.

U.S. Pat. Nos. 6,170,420 B1 and 6,357,373 B1 disclose internal rebuilt double hull vessels and methods of accomplishing same. These patents disclose a process wherein the topside decking is cut and removed and a new inner hull is disposed internally over the existing single hull to form the new double hull. While this internal double hull process works well for barges, it is not as effective for tankers for several reasons including (1) the use of a raised trunk to help maintain the same cargo carrying capacity on a rebuilt barge causes more visibility and operational issues on tanker than on a barge; (2) tankers are generally three tanks across instead of two, which causes structural complications with the new double sides not normally experienced with barges; (3) tankers typically have more services (fuel, oil, electricity, water, cargo handling, ship handling, etc.) that would be disrupted during a rebuild by cutting up the deck to create a raised deck than would a typical barge; (4) the increase in draft due to the additional weight of the new double hull would be greater for a typical tanker than a typical barge due to hull shape of a tanker, which would adversely affects marketing and may limit the cargo in several ports; (5) the extra steel weight on a tanker would represent lost cargo weight unlike the barge where the extra draft is allowed by regulation and compensates for the extra steel weight; (6) hull bending moment issues arising from the concentrated weights in the tanker's engine room which typically do not exist on a barge; and (7) the method used on a typical barge retrofit is difficult to accomplish on a typical tanker due to access and interference problems and modification of existing ship structure and piping.

Therefore, a need exists for a rebuilt tanker having a double hull having substantially the same cargo carrying capability at substantially the same or a reduced draft. The need also exists for an improved method of rebuilding an existing single hull tanker into a rebuilt double hull tanker that minimizes disruptions in existing ship services and accounts for access and interferences problems and modifications of existing ship structure and piping.

SUMMARY OF THE INVENTION

The present invention is directed to a double hull tanker rebuilt from an existing single hull tanker. The rebuilt double hull tanker includes a new double bottom hull and a new double side hull (e.g., port and starboard) formed over at least a cargo carrying portion of the rebuilt tanker. The new double bottom hull includes an inner bottom hull formed from new inner bottom plating disposed internally and in a spaced apart relationship with an outer bottom hull formed from the existing bottom plating. The new port and starboard double side hulls include a new outer side hull formed from new outer side plating disposed externally and in a spaced apart relationship with an inner side hull formed from existing side plating. The rebuilt double bottom hull is connected at each end (e.g., at the turn of the bilge) to the rebuilt double side hulls.

According to one aspect of the invention, a plurality of connecting members connect the new inner bottom hull and the existing outer bottom hull in a spaced apart relationship. In one preferred embodiment, the plurality of connecting members that connect the new inner bottom hull and the existing outer bottom hull include existing web framing. In this embodiment, the new inner bottom plating is laid on top of and connected directly to the existing web framing. In one embodiment, the existing web framing further comprises transverse stiffening members.

According to another aspect of the invention, the rebuilt double hull tanker includes a space formed between the new inner bottom hull and the existing outer bottom hull. Preferably, the bottom space comprises a distance H between the new inner bottom hull and the existing outer bottom hull measured at right angles, wherein H is not less than H=beam/15 or 2 meters, whichever is the lesser, and wherein the minimum value of H=1 meter.

According to another aspect of the invention, the rebuilt double hull tanker includes a plurality of connecting members connecting the existing inner side hull and the new outer side hull in a spaced apart relationship. In one embodiment, the side connecting members includes new connecting plates connected at a first end to the existing side plating of the existing inner side hull and connected at a second end to the new side plating of the new outer side hull. In another embodiment, the first end of the connecting plates are butt into the existing inner side hull plating in way of an existing supporting web frame and the second end of the connecting plates are lapped on a face of new vertical side shell stiffeners of the new outer side hull.

According to another aspect of the invention, a side space is formed between the existing inner side hull and the new outer side hull. Preferably, the minimum side spacing is based on the deadweight of the tanker and extends either for the full depth of the rebuilt double hull tanker's side or from a top of the double bottom hull to a topside deck. The minimum side spacing is preferably defined by a distance W which is measured at any cross-section at right angles to the existing inner side hull and defined by W=0.5+deadweight/20,000(m) or 2 meters, whichever is the lesser, and wherein the minimum value of W=1 meter.

According to another aspect of the invention, temporary access holes are provided in the existing side hull at a location just above the existing stiffening members for installation of the new inner bottom hull over the existing outer bottom hull. Also, temporary access apertures can be provided in one or more longitudinal bulkheads to facilitate installation of the new inner bottom hull over a portion of the cargo hull from the side shell with the access holes to a longitudinal bulkhead in the way of one cargo hull. Inserts are used to renew the access holes and access apertures after installation of the new inner hull. Preferably, the cutout sections of the side shell and the lower portion of the longitudinal bulkheads are reused as the inserts.

Preferably, the temporary access holes are only cut on either a port side or a starboard side of the tanker at a time and in way of only one adjacent cargo hold at a time and the integrity of the opposite side of the tanker is kept intact to maintain the structural strength of the tanker. In embodiments where the tanker to be rebuilt includes multiple cargo holds, the new inner bottom hull can be installed simultaneously in more than one cargo hold with adjacent cargo holds being worked from alternative port and starboard sides of the tanker in order to retain structural integrity and sufficient strength during the installation process of the new inner bottom hull.

Preferably, the rebuilt double hull tanker maintains substantially the same cargo carrying capability as the existing single hull tanker. In one embodiment this can be accomplished by converting one or more existing ballast tanks to cargo tanks and using a space between one or both of the new inner bottom hull and the new outer bottom hull of the new double bottom hull and the new outer side hulls and the existing inner side hulls of the new side double hulls as new ballast tanks. In another embodiment, the rebuilt double hull tanker has an increased cargo carrying capability as compared to the existing single hull tanker.

The rebuilt double hull tanker preferably reuses the existing hull structure to the maximum extent possible. In one preferred embodiment substantially all of the existing hull structure is reused.

The draft of the rebuilt double hull tanker is preferably reduced for the same cargo load by installing the new double side hulls externally over the existing inner side hull. Installing the new outer side hull externally over the existing inner side hull results in an increase in the beam of the rebuilt double hull tanker and also an increase in the buoyancy for the rebuilt double hull tanker as compared to the existing single hull tanker.

In one preferred embodiment, a portion of the existing single hull is cut-away at a turn of the bilge. This facilitates the installation of the new inner hull through the side shell of the tanker. In one embodiment, new bottom filler pieces are connected to each outboard end of the new double bottom hull where the existing turn of the bilge was cut-away. Preferably, the new bottom filler pieces are scribed to match the existing outer bottom hull, including any dead rise, and directly support the inner side hulls. The cut-away portion of the turn of the bilge is preferably reused after installation of the new inner hull. The cut-away portion of the turn of the bilge is connected to an outboard end of the new bottom filler pieces. New outer side filler pieces including the new outer side hull are preferably connected over the exterior of the existing port and starboard inner side hulls and connected to the existing turn of the bilges. The new outer side filler pieces include new outer portions of topside deck plating that are preferably scribed out to match a contour of the shear strake of existing topside deck plating and that are connected to an outer periphery of the existing topside deck plating.

In accordance with another embodiment within the scope of the present invention, the rebuilt double hull tanker includes faired sections formed between the new double side hulls and the existing side hull of the single hull. The faired sections provide a relatively smooth transition between the new outer side hulls and the outer hull of the existing single hull proximate a bow section and a stern section for a smoothing hydrodynamic transition fore and aft in the area where the new double side hull and the existing single side hull meet. Preferably, the faired sections partially comprise an elastomer fairing compound.

The present invention also includes a method of rebuilding an existing single hull tanker into a rebuilt double hull tanker. The method includes forming a new double hull having a new double bottom hull and new side hulls connected at each outboard end of the new double bottom hull. The new double bottom hull is formed by disposing a new inner bottom hull through the side shell of the tanker internally over the existing outer bottom hull. The new double side hulls are formed by disposing a new outer side hull externally over the existing inner side hull. Preferably, the new double hull is formed over at least the cargo carrying portion of the tanker by installing the new inner bottom hull internally over the existing outer bottom hull through access holes cut into the sides of the tanker and installing the new double side hulls externally over the existing inner side hulls.

In accordance with another aspect of the invention, the method further comprises installing the new inner bottom hull simultaneously in more than one cargo hold with adjacent cargo holds being worked from alternative port and starboard sides of the tanker in order to retain structural integrity and sufficient strength during the installation process of the new inner bottom hull.

Additional features of the present invention are set forth below.

DETAILED DESCRIPTION OF THE PREFERRED EMBODIMENTS

Figure 1:
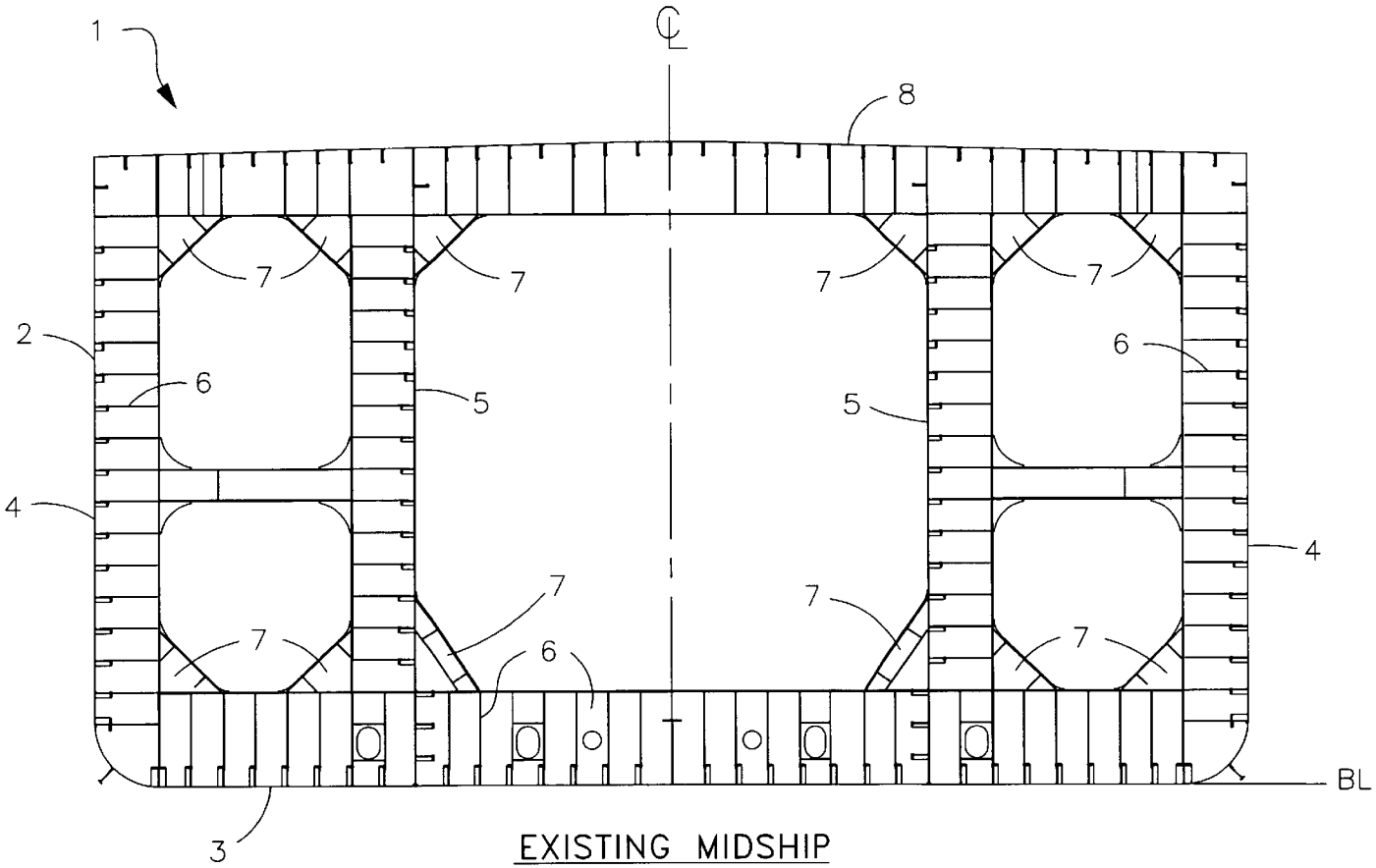
FIG. 1 (PRIOR ART)
FIG. 1 is a cross sectional mid-ship view showing an exemplary prior art tanker having a single hull.

FIG. 1 shows an exemplary existing single hull tanker design. As shown in FIG. 1, the existing single hull tanker 1 includes a single outer hull or skin 2 that provides structural integrity and acts as a boundary between the operating environment of the tanker (e.g., the sea) and the cargo and internal structure of the tanker. As shown, the single hull includes shell plating having bottom plating 3, and port and starboard side plating 4. A plurality of bulkheads 5 and internal stiffening frames 6, act to support and strengthen the shell of the hull. Conventional bulkheads typically include a combination of transverse and longitudinal bulkheads and the internal framing typically includes a combination of transverse and longitudinal members. As shown in FIG. 1, a typical tanker can include a plurality of brackets 7 for supporting and stiffening the cargo hold at, for example, the connection of the side walls and longitudinal bulkhead to the topside deck plating 8 and to the web frames of the bottom hull. The single hull tanker 1 shown in FIG. 1 includes a typical framing design, although the invention is not limited to this type of tanker design.

In the illustrated embodiments of the invention shown in FIGS. 2–7, a rebuilt double hull tanker 10 is shown including a rebuilt double hull 11 comprising a new double bottom hull 12 and new double side hulls 13 (e.g., port and starboard side hulls). The internally rebuilt double bottom hull 12 comprises the existing outer bottom hull 14 (e.g., the existing bottom plating 3) and a new inner bottom hull 15 that is disposed internal and spaced apart from the existing outer bottom hull 14. The externally rebuilt double side hulls 13 comprise the existing inner side hulls 16 (e.g., the existing port and starboard side plating 4) and a new outer side hull 17 disposed external and spaced apart from the existing inner side hull 16. The rebuilt double bottom hull 12 is connected at each end (e.g., at the turn of the bilge 18) to the rebuilt double side hulls 13, comprising port and starboard outer side hulls.

The new inner bottom hull 15 and the new outer side hulls 17 are connected in a spaced apart relationship to the existing outer bottom hull 14 and the existing inner side hulls 16, respectively. One or more watertight cavities 19 are defined between the existing outer bottom hull 14 and the new inner bottom hull 15 and also between the existing inner side hull 16 and the new outer side hull 17. These cavities 19 can be used as tanks for the storage of, for example, ballast.

Figure 2:
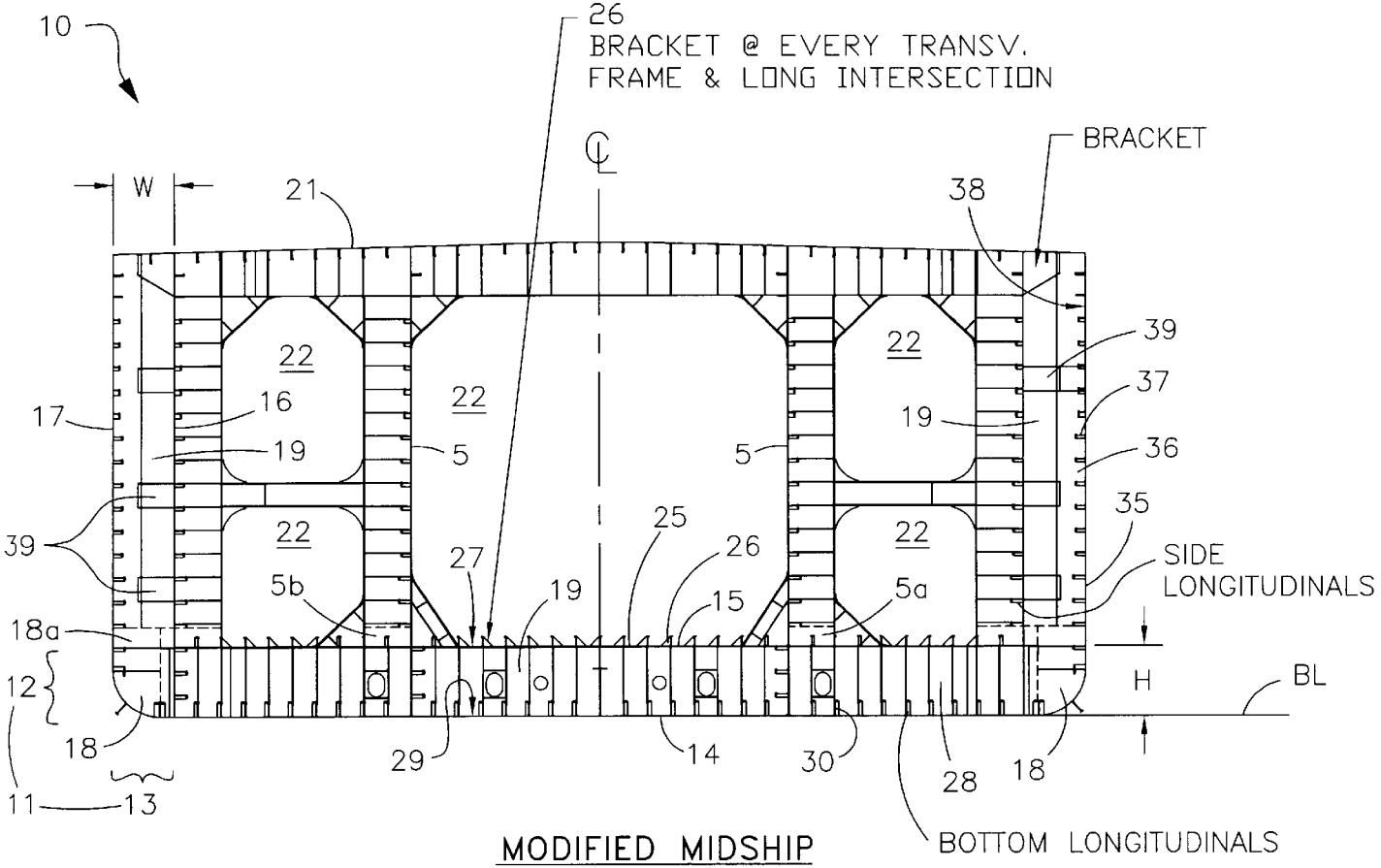
FIG. 2 is a cross sectional mid-ship view at a typical modified web frame showing an exemplary rebuilt double hull tanker in accordance with one embodiment of the present invention.

As shown in FIG. 2, the new inner bottom hull 15, the existing inner side hulls 16, and the topside decking 21, define a cargo hold 22 for carrying a cargo (not shown). The cargo is preferably a liquid cargo. The existing outer bottom hull 14, the new outer side hulls 17, and the topside decking 21 define a boundary with the outside operating environment (e.g., the sea and the air). The cargo hold 22 can be separated into on or more cargo holds by transverse bulkheads, longitudinal bulkheads, or a combination of both.

In one preferred embodiment shown in FIG. 2, the new inner bottom hull 15 includes inner bottom plating 25 and stiffeners 26. As shown in FIG. 2 the stiffeners 26 can include longitudinal stiffeners disposed on a topside surface 27 of the inner bottom plating 25. Locating the stiffeners 26 on the topside 27 of the inner bottom plating 25 is preferred because this arrangement allows for ease of installation because this leaves the bottom-side of the plating smooth, making fit-up easier and the installation process quicker. This preferred configuration also allows the new inner bottom hull 15 to be prefabricated as a plurality of pieces on a jig using, for example, down-hand welding, which also reduces the cost and improves quality of the construction. The stiffeners 26 are preferably connected to the inner bottom plating 25 at equal spacing to provide the necessary structural integrity and stiffening of the inner bottom plating 25.

The new inner bottom hull 15 is connected to the existing outer bottom hull 14 in a spaced apart relationship. As shown in FIG. 2, in a preferred embodiment the new inner bottom hull 15 can be disposed on and connected directly to the existing framing 28 extending inward from the existing outer bottom hull 14 providing the existing frame height H is sufficient to meet OPA-90 requirements for outer and inner hull separation. As shown, in one embodiment the existing framing that the new inner hull 15 is installed over can include the transverse web framing. In an alternative embodiment (not shown), the existing framing could include the existing longitudinal framing 30.

The frame height H is measured, for example, between the topside 29 of the existing outer bottom hull 14 and the topside 27 of the top flange of the transverse web frame 28. Installing and connecting the new inner bottom hull 15 directly to the existing framing 28 is preferred because the use of the existing structure minimizes the amount of work required and the time that the tanker is out of service. Alternatively, if the existing framing height is does not meet OPA-90 requirements, a connecting or filler plate (not shown) can be used to connect the new inner bottom hull 15 to the existing outer bottom hull structure 14.

According to OPA-90, the spacing requirements for double bottom tanks or spaces is defined by the distance H between the bottom of the cargo tanks and the moulded line of the bottom shell plating measured at right angles to the bottom shell plating and is not less than H=beam/15 or 2 meters, whichever is the lesser. The minimum value of H=1 meter.

For the side tanks or spaces, the minimum spacing is based on deadweight and is required to extend either for the full depth of the tanker's side or from the top of the double bottom to the uppermost deck, disregarding a rounded gunwale where fitted. Nowhere should the spacing be less than the distance W which is measured at any cross-section at right angles to the side shell and defined by W=0.5+deadweight/20,000(m) or 2 meters, whichever is the lesser. The minimum value of W=1 meter.

As shown in FIG. 2, the new outer side hull 17 each include side plating 35, web framing 36, and stiffeners 37. As shown, the web framing 36 can include transverse web framing that is connected to an interior surface 38 of the new outer side plating 35 and extends inward toward the existing inner side hull 16. The stiffeners 37 can include longitudinal stiffeners disposed on the interior surface 38 of the new outer side plating 35 at equal spacing to provide the necessary structural integrity and stiffening of the new outer side plating 35. The new outer side hulls 17 are connected to the existing inner side hulls 16 in a spaced apart relationship.

As shown in FIG. 2, connecting plates 39 can be used to connect the new external side plating 35 of the new outer side hull 17 to the side plating of the existing inner side hull 16.

Preferably, the rebuild process includes removal and reuse of the existing turn of the bilge 18. This piece is cut-out and removed for installation of the new inner hull 15 from the side of the tanker. The turn of the bilge 18 may be reworked as necessary for re-installation after the new inner hull 15 has been installed. Preferably, the cut-out of the turn of the bilge includes at least a portion 18*a* of the existing side shell vertically above the existing web framing proximate the top of the turn of the bilge.

Due to the increase in the beam B of the tanker resulting from the new outer side hulls 13, filler pieces or new bottom filler pieces 62 are installed at each end of the double bottom hull 12 and then the turn of the bilge 18 is connected to the outer ends of the new bottom filler pieces 62. Preferably, the width of the new bottom filler pieces 62 is approximately equal to the width of the new outer side hulls 13.

Figure 3:
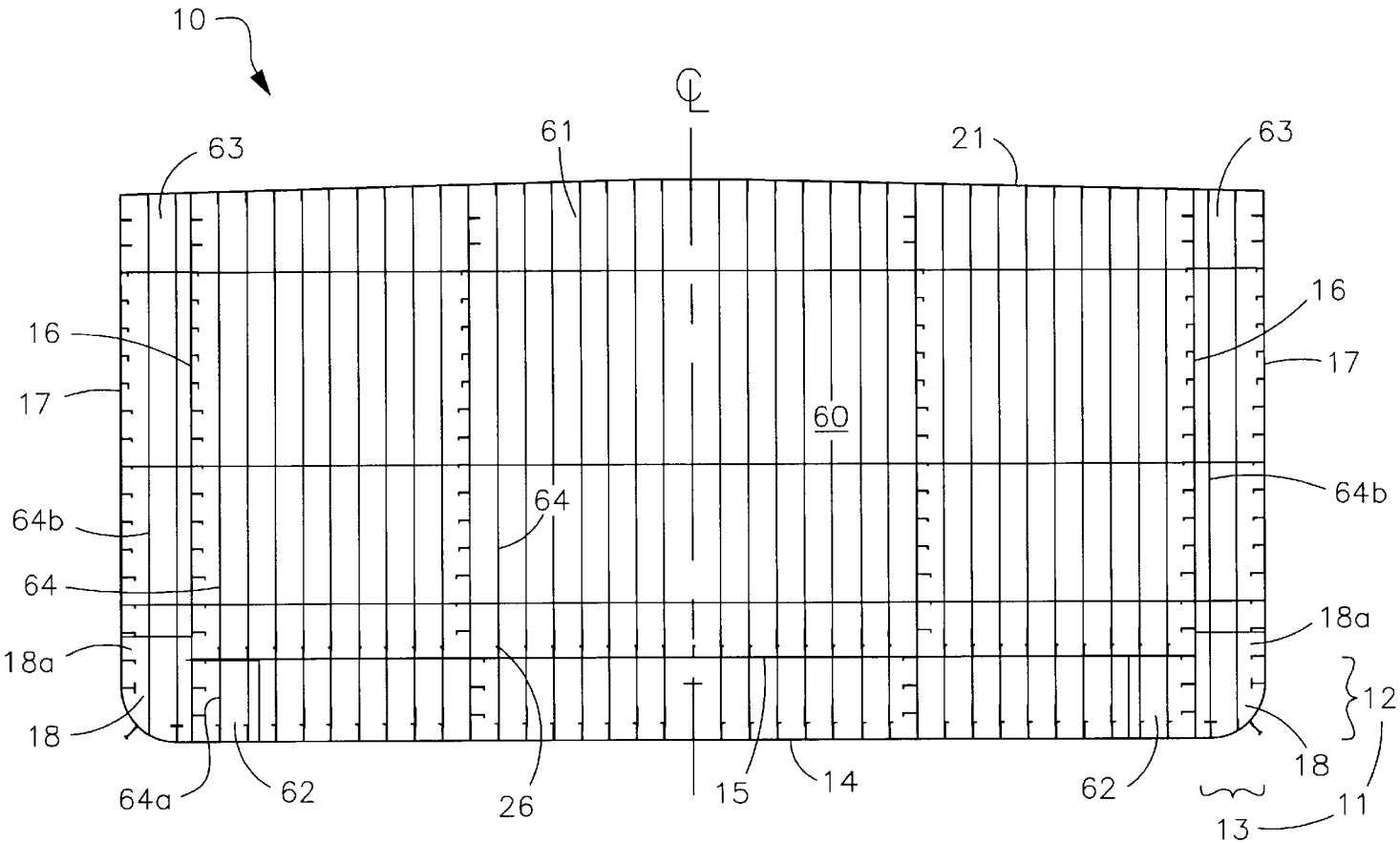
FIG. 3 is a cross sectional mid-ship view at a typical modified bulkhead of an exemplary rebuilt double hull tanker in accordance with one embodiment of the present invention.

FIG. 3 is a cross-sectional view of a rebuilt double hull tanker 10 showing an exemplary modified bulkhead 60 that includes the new inner bottom hull 15 fitted internally in relation to the existing outer bottom hull 14 and new outer side hulls 17 fitted externally in relation to the existing inner side hulls 16. As shown in FIG. 3, the rebuilt bulkhead 60 includes the existing bulkhead structure 61, new bottom filler pieces 62, and new side filler pieces 63. The bottom filler pieces 62 are used to fill the space between the existing bottom hull structure and the turn of the bilge resulting from the increase in the beam B resulting from the new external side filler pieces 63. In one embodiment, the bottom filler pieces 62 are sized to fill a space that has a width that is approximately equal to the width of the new double side hulls 13 and a height approximately equal to the height of the new double bottom hull 12. The two side filler pieces 63 extend from the top of the turn of the bilge on both the port and starboard sides up to the topside deck plating 21. The width of the side filler pieces 63 is determined by the width of the rebuilt double side hulls 13.

Stiffeners 64 are provided for stiffening the rebuilt bulkhead 60. As shown in FIG. 3, the new longitudinal stiffeners 26 are attached to the existing bulkhead stiffeners 64. New portions of bulkhead stiffeners 64*a* are provided in the area of the bottom filler pieces 62 that correspond to and are connected to the existing bulkhead stiffeners 64 and new bulkhead stiffeners 64b are provided on the new side filler pieces 63.

Figure 4:
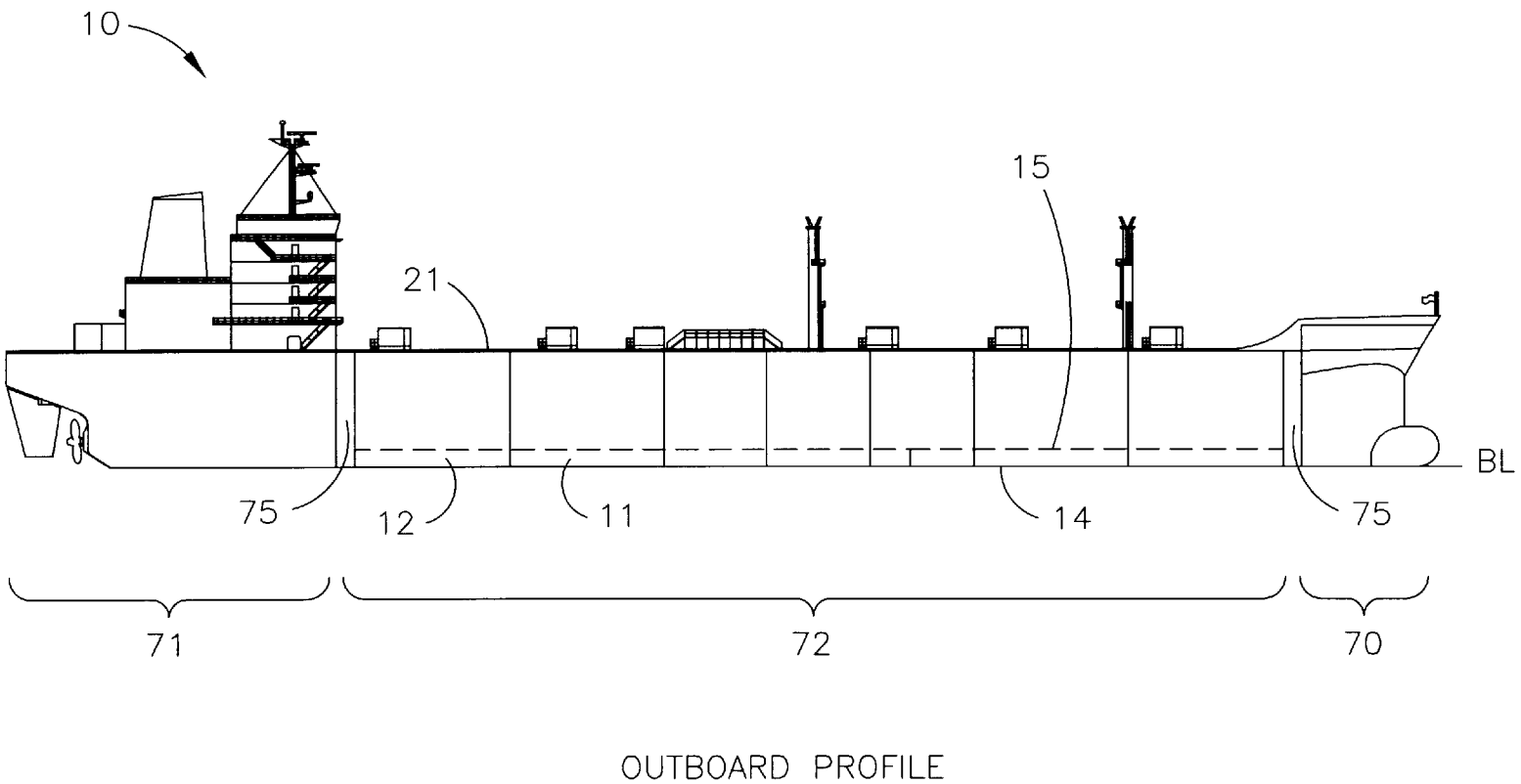
FIG. 4 shows an outboard profile of an exemplary rebuilt double hull tanker.
Figure 5:
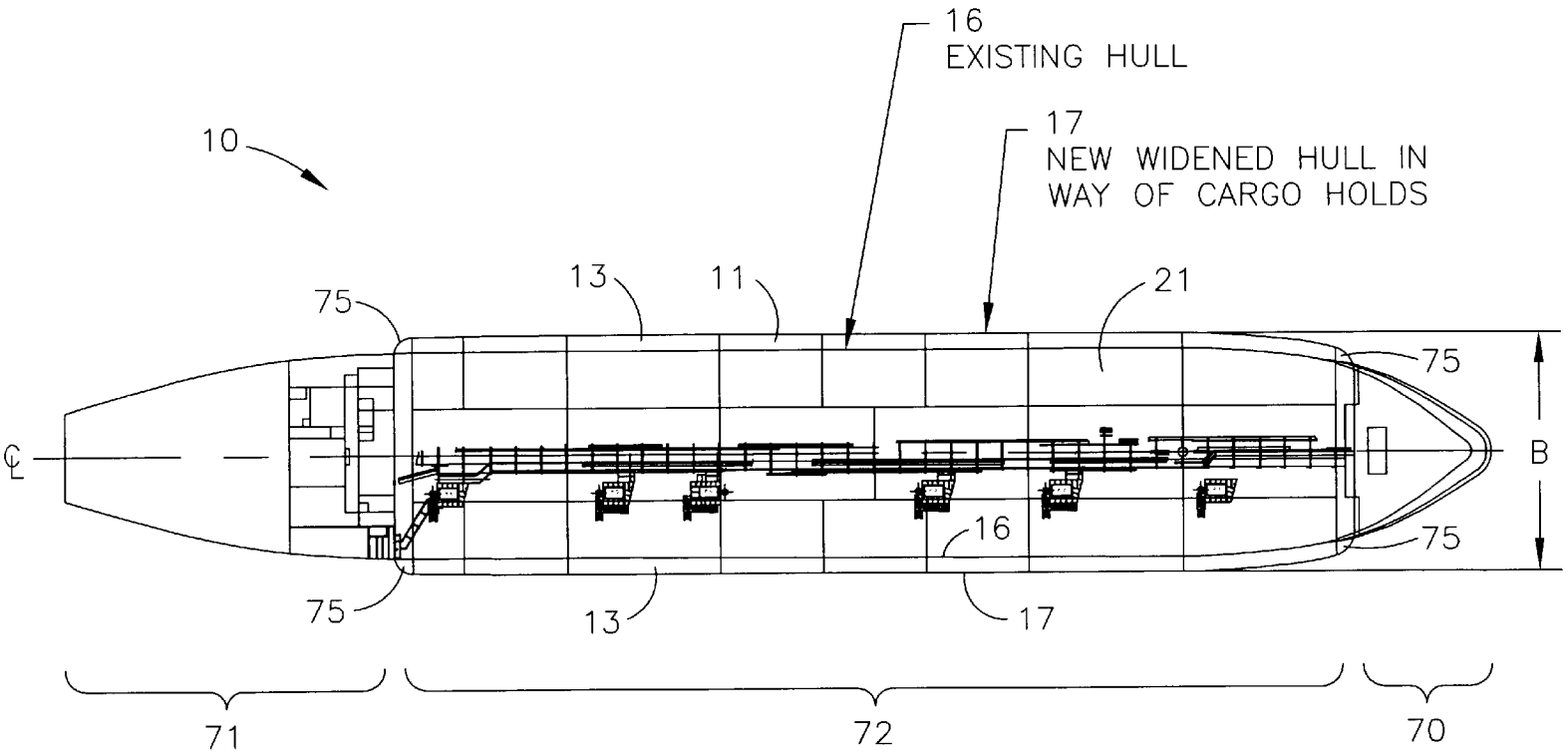
FIG. 5 shows a plan view of the exemplary tanker of FIG. 4.

FIG. 4 is an outboard profile of the rebuilt double hull tanker 10 and FIG. 5 shows a plan view of the rebuilt double hull tanker 10 illustrating the new double hull 11, including the new double bottom hull 12 and the port and starboard double side hulls 13. As shown in FIGS. 4 and 5, the rebuilt double hull 11 extends between the bow section 70 and the stem section 71 of the rebuilt tanker 10. Preferably, the rebuilt double hull 11 extends over at least the length of the cargo carrying portion 72 of the tanker 10.

The existing bottom hull 3 from the original single hull tanker 1 forms the outer bottom hull 14 of the rebuilt double hull tanker 10, which provides an advantage in that this bottom hull has been proven in service. The existing side hulls 4 from the original single hull tanker forms the inner side hulls 16 of the rebuilt double hull tanker 10, which provides an advantage in that these side hulls are suitable for contact with a cargo. As can be seen from FIGS. 4 and 5, the insertion of the new inner bottom hull 15 from the side of the tanker 10 and the new outer side hulls 17 installed externally allows the conversion of the tanker 10 with no or minimal disruption of the topside deck plating 21, machinery, piping, super structure, and the like.

As can be seen from FIG. 4, the base line BL of the tanker remains the same for the rebuilt double hull tanker 10 as it was for the original single hull vessel 1. As illustrated in FIG. 5, the beam B of the rebuilt double hull tanker 10 is greater than the beam of the original single hull tanker 1. The increase in the beam B of the rebuilt double hull tanker 10 is approximately equal to the width of the two new double side hulls 13 (e.g., the port and starboard side hulls). In the preferred embodiment shown in FIGS. 4 and 5, this widened beam B of the rebuilt double hull tanker 10 resulting from the new double side hulls 13 is formed at least over the length of the cargo carrying portion 72.

FIGS. 4 and 5 also show faired sections 75 that form a relatively smooth transition between the new outer side hulls 17 and the outer hull 4 of the existing single hull 2 proximate the bow section 70 and the stern section 71. The faired sections 75 provide for a smoothing hydrodynamic transition fore and aft. In one embodiment, the faired sections 75 are formed with an elastomer fairing compound.

Figure 6:
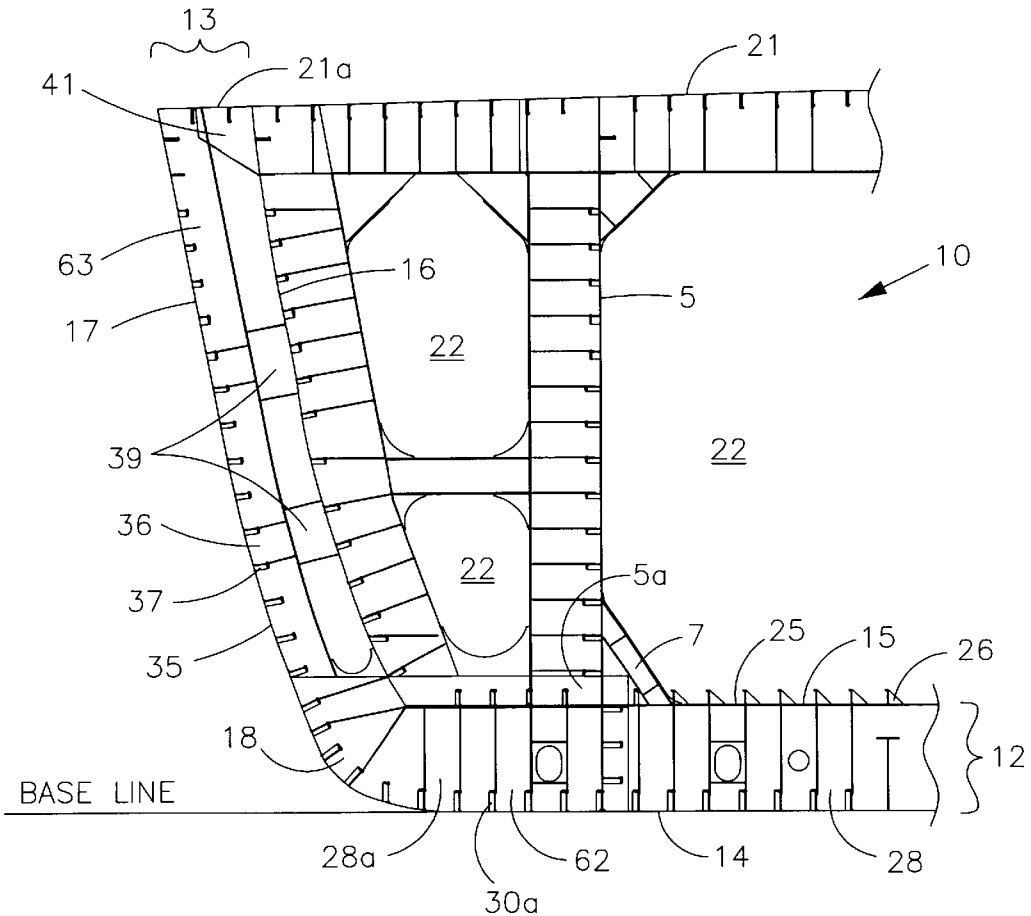
FIG. 6 shows a partial cross-sectional view at a forward web frame of the tanker of FIG. 4 looking forward.

FIG. 6 shows a partial cross-sectional view at a forward web frame 28 of the tanker 10 of FIGS. 4 and 5 looking forward. Basically, the same method described heretofore is applicable for the forwardmost to the aftmost frames for the entire cargo length. As shown in FIG. 6, the rebuilt double hull 10 includes existing topside deck plating 21, existing outer bottom hull plating 14, existing inner side hull plating 16, existing longitudinal bulkhead 5, existing turn of the bilge 18, existing support brackets 7, new inner bottom plating 25, new inner bottom stiffeners 26, new outer side shell plating 35, new bottom filler piece 62, new side filler piece 63, and new bracket 41.

As shown, the new inner bottom plating 25 of the new inner hull 15 is disposed over and connected to the web frames 28 extending upward from the existing outer bottom hull 14. A bottom portion 5*a* of the longitudinal bulkhead(s) 5 can be cut out and removed to allow installation of the new inner bottom hull 15 and preferably this same piece is re-installed after the new inner bottom 15 has been installed.

A new bottom filler piece 62 is connected at each end (port and starboard) of the new double bottom 12. The existing turn of the bilges 18 (port and starboard) are connected to the outboard end of each of the new bottom filler pieces 62.

The new outer side shell plating 35 of the new outer side hull 17 is connected to the existing inner side hull plating 16 using connecting plates 39. Preferably, the new side filler pieces 63, including the new outer side plating 35, new side shell web framing 36, new side shell stiffeners 37, and the connecting plates 39, are prefabricated and installed as one piece.

The new outer portion 21*a* of the topside deck plating is then connected to the outer periphery edge of the existing topside deck plating 21. Preferably, the existing topside deck plating 21 is left substantially undisturbed. As shown in FIG. 6, a bracket 41 can be used to attach and stiffen the new topside deck plating 21*a* to the existing ship structure.

Stiffeners 26, 28, 36, 37 are provided on the new structure to support and stiffen the new shell plating 25, 35. For example, as shown in FIG. 6 the new inner bottom plating 25 includes new longitudinal stiffeners 26, the new bottom filler pieces 62 can include transverse stiffener 28*a* and longitudinal stiffeners 30*a*, and the new side filler pieces 63 can include transverse stiffeners 36 and longitudinal stiffeners 37.

Figure 7:
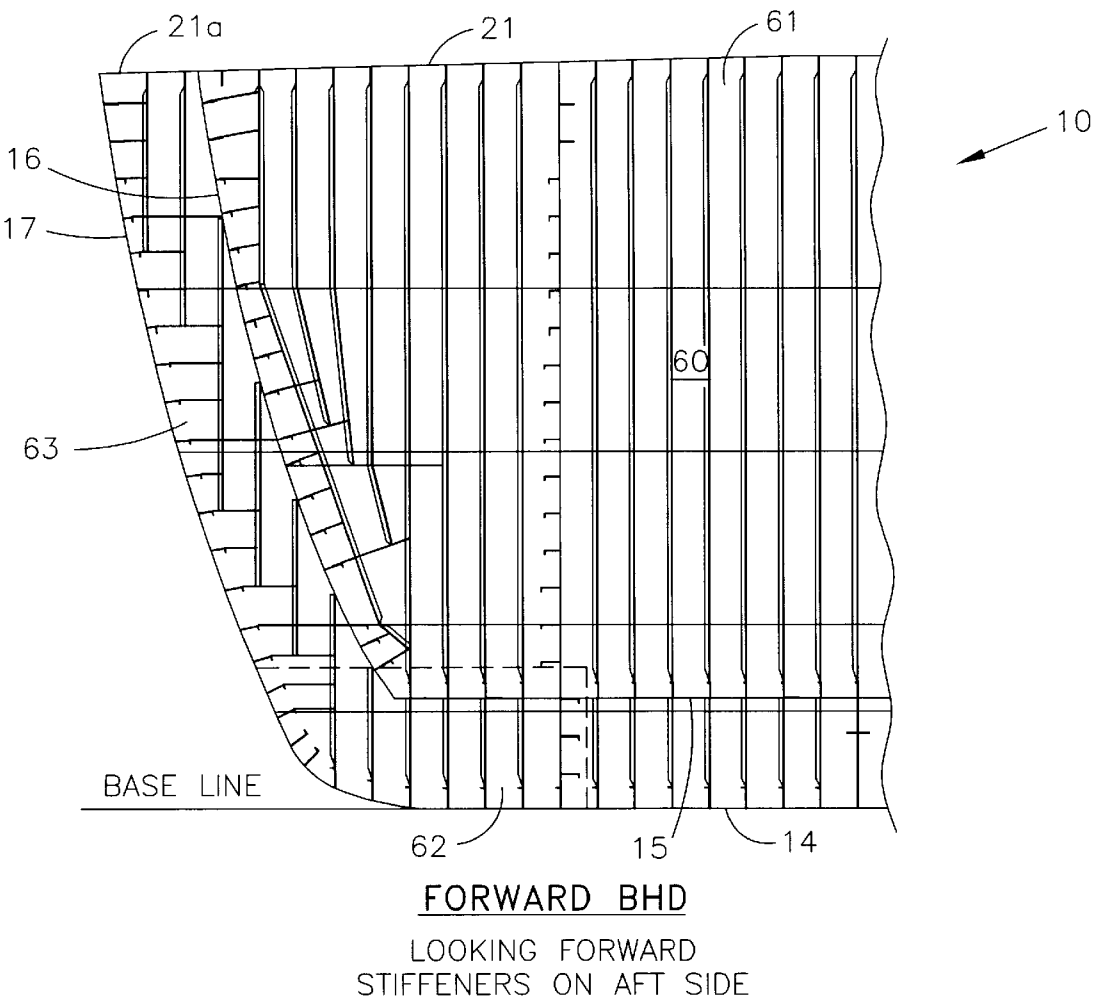
FIG. 7 shows a partial cross-sectional view at a forward bulkhead of the tanker of FIG. 4 looking forward.

FIG. 7 shows a partial cross-sectional view at a forward bulkhead of the rebuilt tanker 10 of FIGS. 4 and 5 looking forward. Basically, the same method described heretofore is applicable for the forwardmost and aftmost bulkheads for the entire cargo length. As shown in FIG. 7, the modified or rebuilt bulkhead 60 includes the existing transverse bulkhead 61, the new bottom filler piece 62, the new side filler piece 63, the existing turn of the bilge 18, the existing topside deck plating 21, the new topside deck plating 21*a*, the existing outer bottom hull 14, the existing inner side hull 16, the new inner bottom hull 15, and the new outer side hull 17.

FIGS. 8–15 show a partial cross-section of an exemplary tanker and illustrate an exemplary process of rebuilding an existing single hull tanker 1 into a rebuilt double hull tanker 10.

Normally, the vessel will be gas freed, cleared for hot work and dry-docked prior to commencement of the process of rebuilding an existing single hull tanker into a rebuilt double hull tanker. The tanks will be cleaned of all residual debris, and the appropriate set-up, staging and the like will be installed as required for the double hulling process. Typically, this would include lighting, access holes in way of the bottom, working platforms, etc. Preferably, the removed steel is reused whenever possible. Alternatively, the items identified to be reinstalled may be renewed with new steel. The items to be removed will be identified, as well as the items to be removed and reinstalled.

Figure 8:
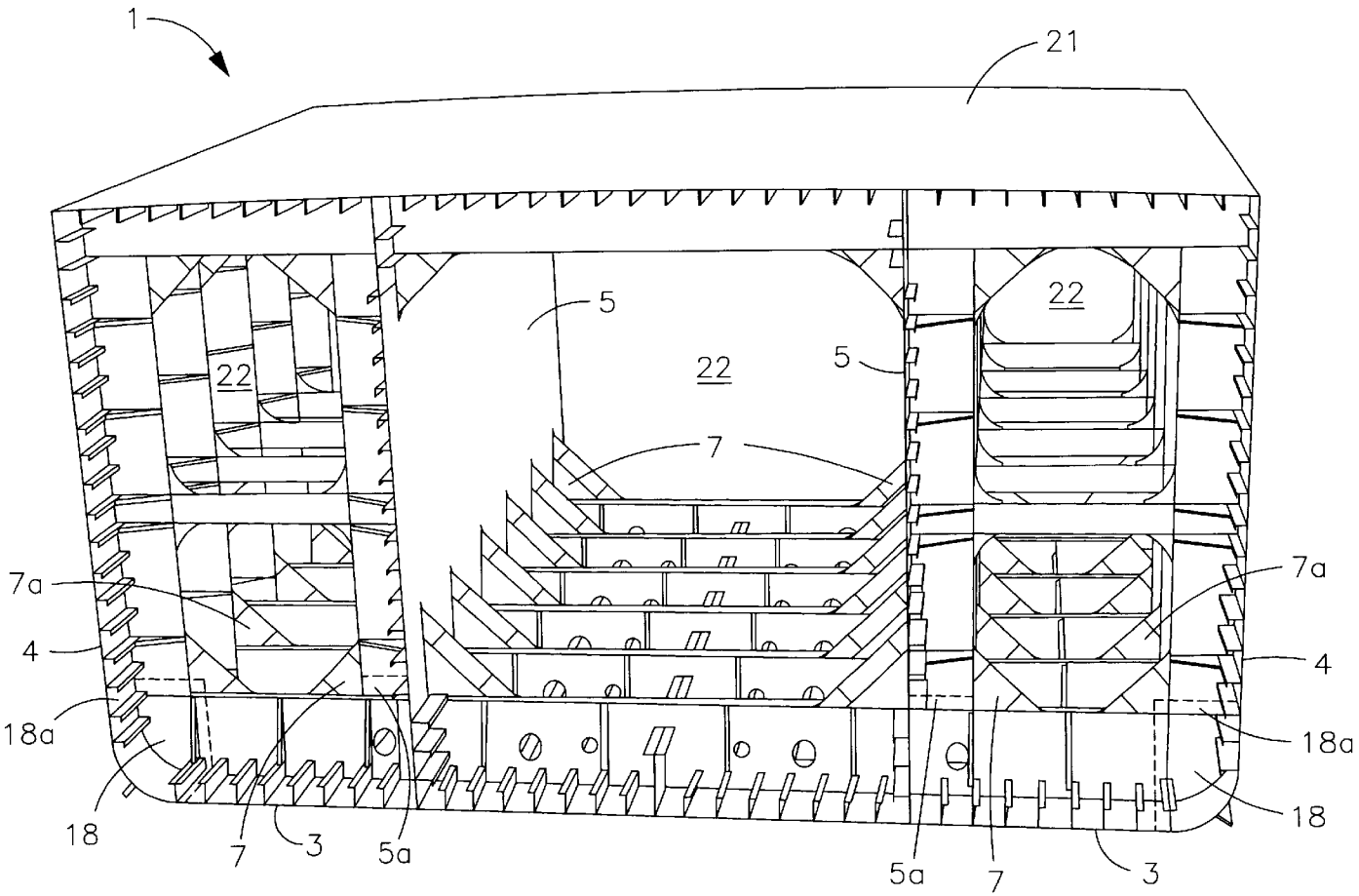
FIG. 8 shows an exemplary single hull tanker illustrating the existing structure that will be cut-out in accordance with one embodiment of the present invention.
Figure 9:
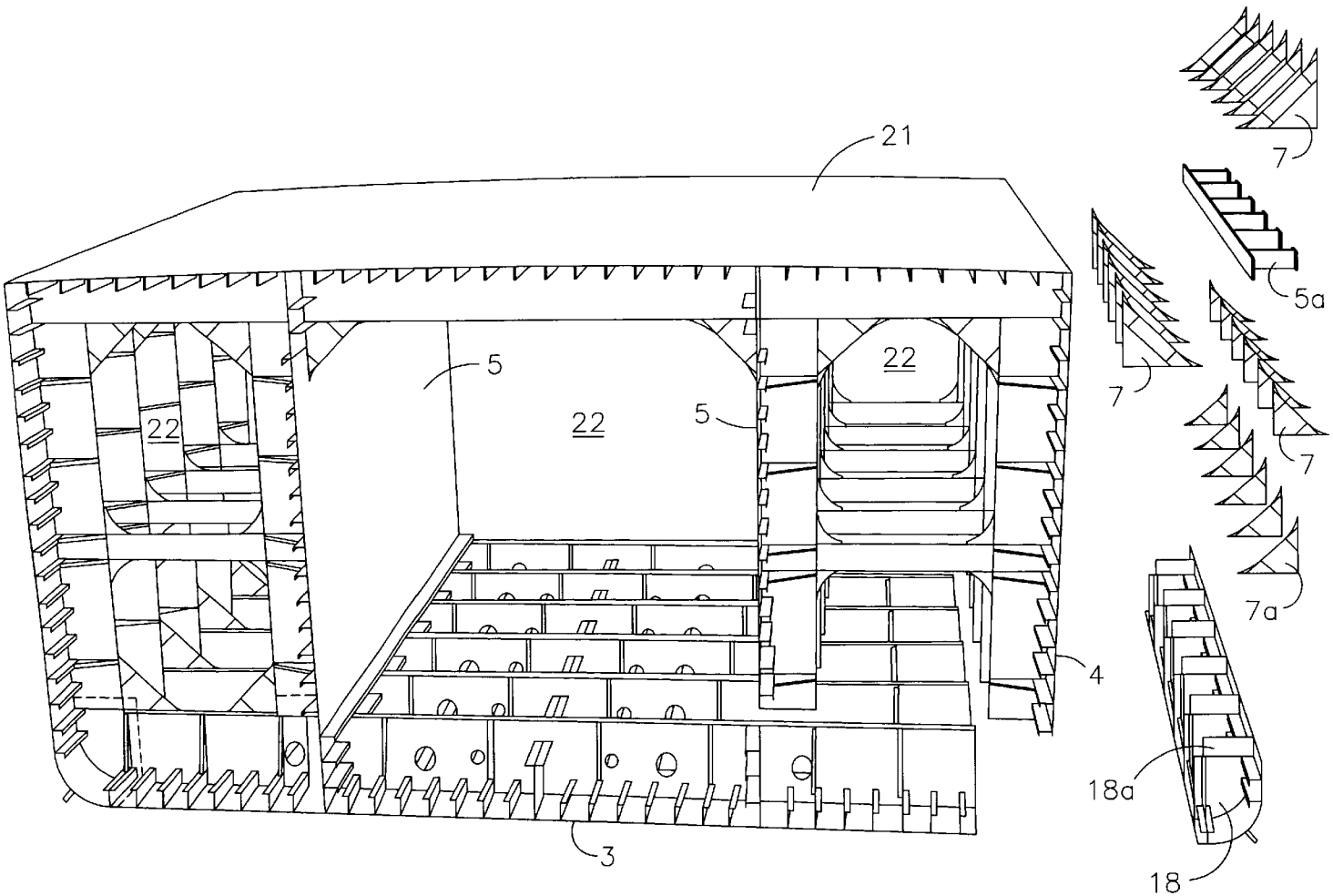
FIG. 9 shows the exemplary tanker of FIG. 8 with the cut-out structure removed from a first side and center area of the existing single hull to allow installation of the new inner bottom hull.

As shown in FIGS. 8 and 9, cutting can begin once the tanker is ready for hot work. The first item to be cutout is the turn of the bilge 18 and can include a small section of the bottom plating (not shown) and/or the side shell 18*a* immediately adjacent to the turn of the bilge. The turn of the bilge 18 will be set aside and preferably reinstalled at a later time. One of the benefits to reusing this piece is that is saves the bilge keel as well as the turn of the bilge. Since the turn of the bilge 18 is a shaped piece it is more expensive to install than flat plate and there is a significant cost savings realized in reusing this piece. In addition, a good deal of welding is saved from preserving the bilge keel. The outboard most brackets 7*a* that formerly stiffened the side shell vertical web frame can be removed and discarded. Due to the nature of the new side shell installation these brackets are no longer required. In an alternative embodiment wherein the existing single hull tanker includes outer wing tanks, the existing outer wing tank brackets between the existing outer wing tanks and existing transverse framing can be cut out and removed, and stiffening of the existing wing tanks can be provided by the new double side hulls.

The removal of the turn of the bilge 18, a lower portion 5*a* of the longitudinal bulkhead 5, and associated brackets 7 forms access ports 80 through the outer side shell 4 and access apertures 80*a* through the longitudinal bulkheads 5. The access ports 80 and access apertures 80*a* provide access to the cargo holds 22 through the side of the tanker. Preferably, the removal of structure 18, 18*a*, 5*a*, 7, 7*a* and formation of access ports 80 and access apertures 80*a* is affected on either the port side or starboard side at one time, in way of one hold. FIG. 9 shows the turn of the bilge 18, the lower portion 5*a* of longitudinal bulkhead, brackets 7, and brackets 7*a* removed from one side at a time. The integrity of the opposite side of the tanker is preferably kept intact to maintain the structural strength of the tanker.

In embodiments where the tanker to be rebuilt includes multiple cargo holds, the new inner bottom hull 15 can be installed simultaneously in more than one cargo hold with adjacent cargo holds being worked from alternative port and starboard sides of the tanker in order to retain structural integrity and sufficient strength during the installation process of the new inner bottom hull 15.

Figure 10A:
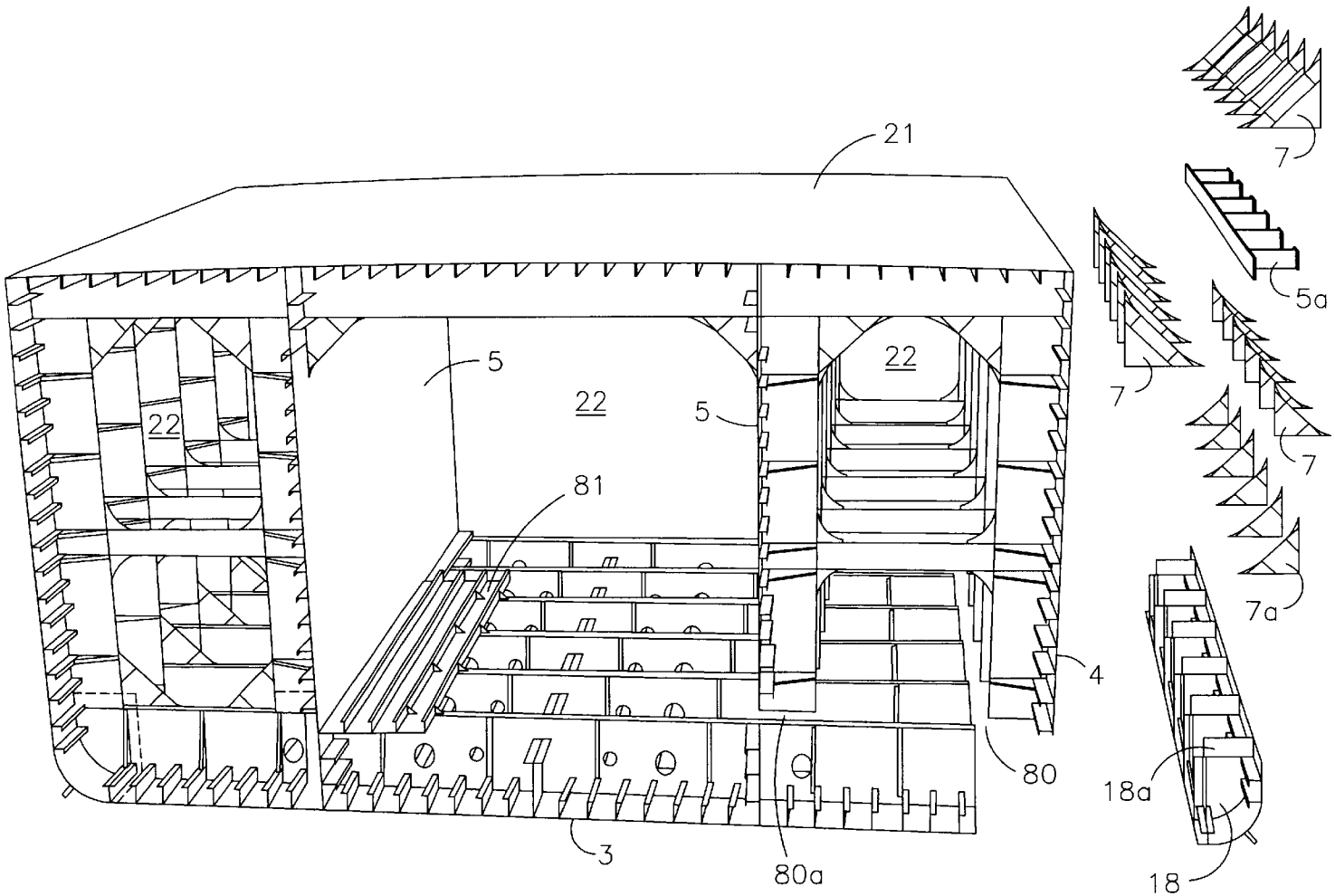
FIGS. 10A–10C show the installation of the new inner hull, the longitudinal bulkhead renewed, and re-installation of support brackets.
Figure 10B:
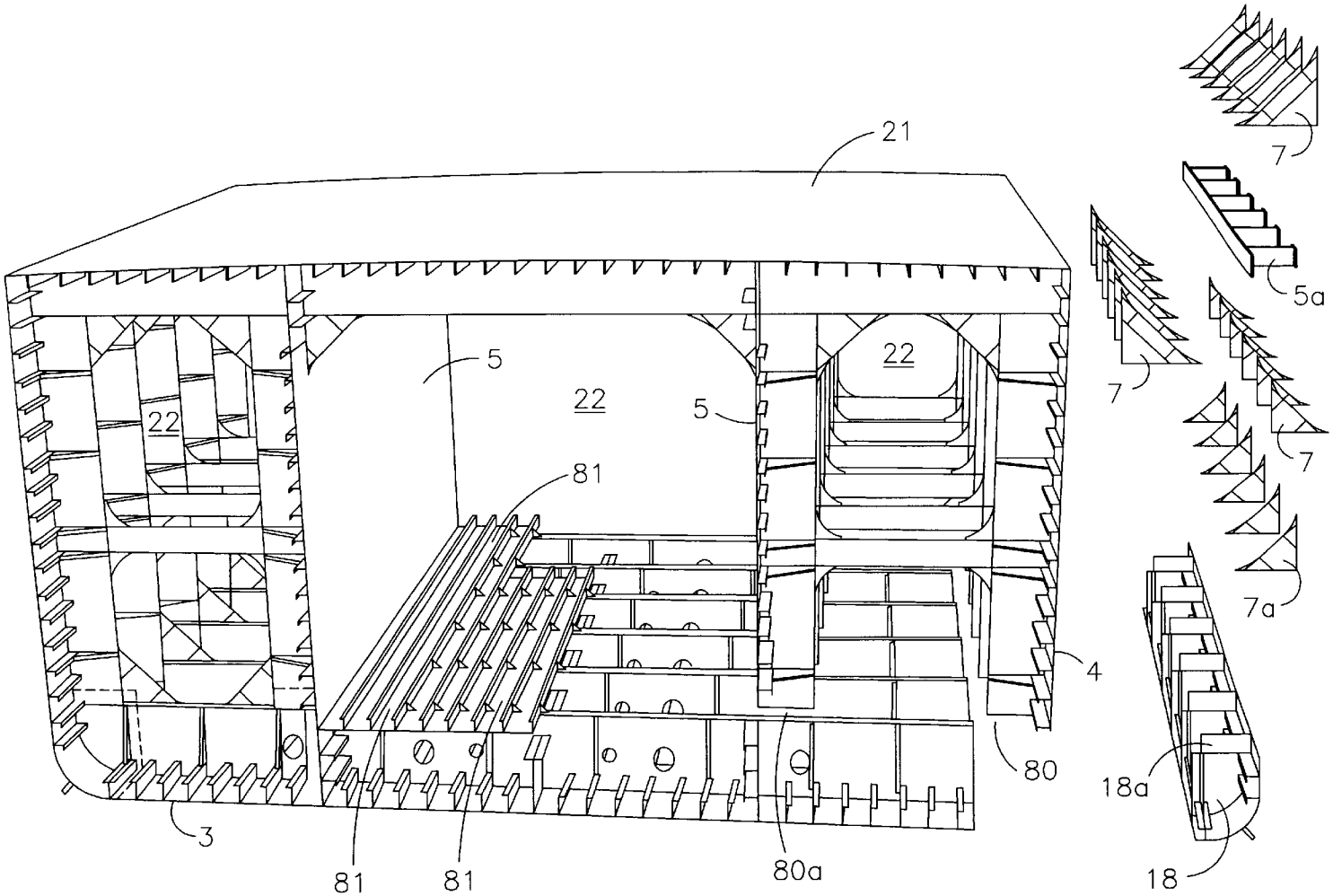
Figure 10C:
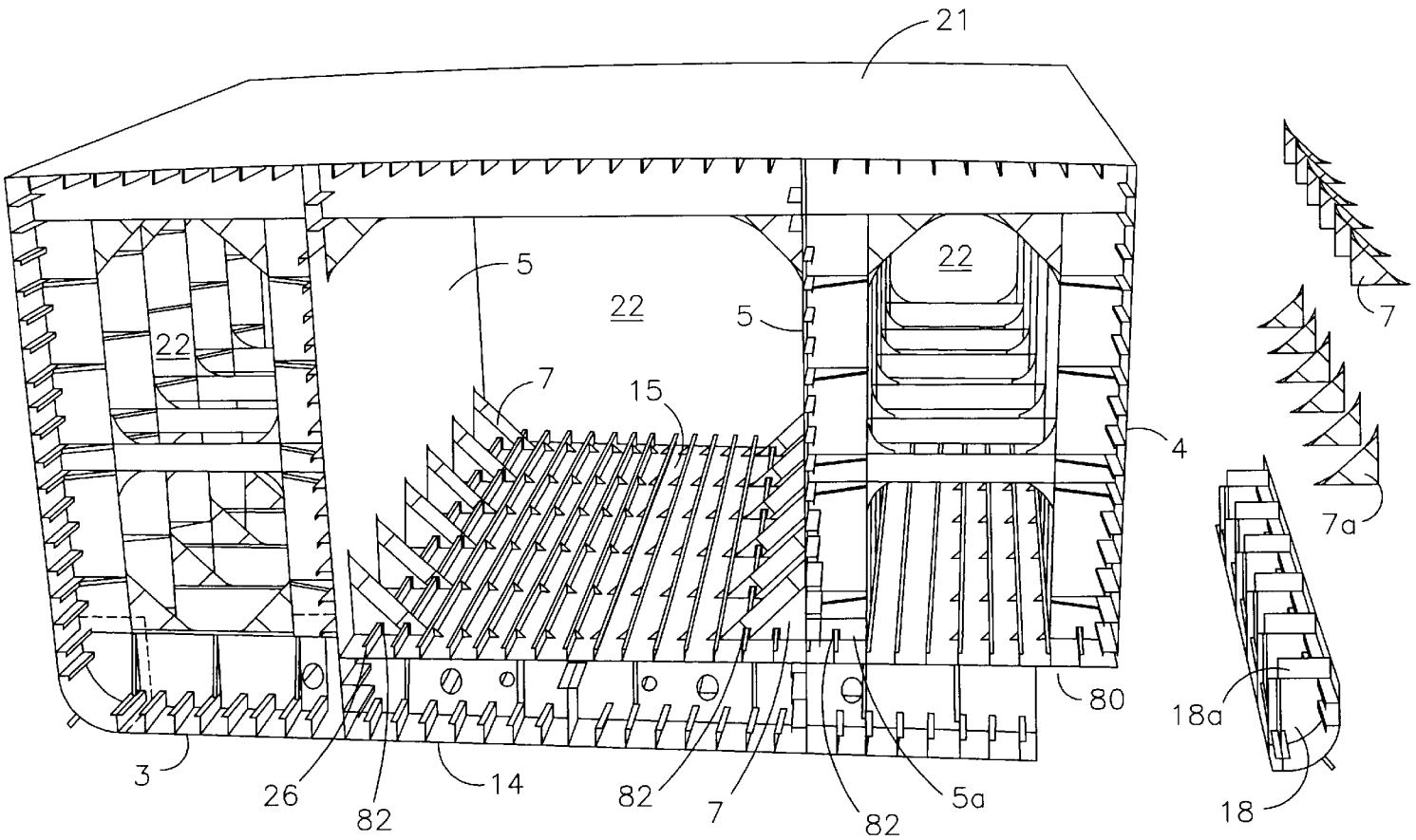

As shown in FIGS. 10A–10C, once the access ports 80 and access apertures 80*a* are open, the material for the new inner bottom hull 15 can be installed. Preferably, the new inner bottom hull 15 is prefabricated off-site of the actual rebuild to save time and also is fabricated in a plurality of sections to facilitate installation of the new structure through the access ports 80 and/or the access apertures 80*a*.

In one embodiment, a plurality of stiffened panels are prefabricated on a jig in a shop that allows for a faster, better fit-up and weld procedure than could be accomplished in place. In the illustrated embodiment, the panels 81 include a length and width comprising common size plates and sized to fit through the access ports 80. The number and size of the panels 81 will depend on the particular application and the size of the tanker that is being rebuilt. The appropriate number and size panels are slid in place through the access ports 80 and/or access apertures 80*a* to complete the new inner bottom hull 15 from one transverse bulkhead (not shown) to the next transverse bulkhead (not shown). The size (e.g., length and/or width) of the panels 81 may be changed, and if standard size plates are not available, then the plate can be fabricate as desired on, for example, a special millrun. In another embodiment, the overall size of the panels 81 can also be increase in order to reduce the number of longitudinal butt seams required.

FIGS. 10B and 10C show the continuation of the installation of the new inner bottom hull 15. FIG. 10B shows a second panel 81 being installed. One or more panels 81 are installed until the floor is closed in the fore and aft and the transverse directions. As shown, the new inner bottom work can progress towards the side shell 4.

FIG. 10B shows the inner bottom hull 15 partially completed. During this process the brackets 7, which support the far side longitudinal bulkhead 5, can be fitted and installed. As can be seen by the illustration, the brackets 7 preferably have cutouts 82 to allow for the passage and support of the inner bottom longitudinal 26. Preferably, these cutouts 82 are done during the initial phases when the brackets 7 are cut-out and removed, such that the brackets 7 are immediately ready to be installed. At the original side shell 4 the inner bottom 15 should be scribed and fit such that the new extension of the longitudinal bulkhead can be placed.

FIG. 10C shows the inner bottom hull 15 partially completed all the way up to the side shell 4. The longitudinal bulkhead 5 is completely renewed and the remainder of the bracketing 7 is installed. Preferably, the longitudinal bulkhead 5 is renewed using the same lower portion 5*a* that was previously removed. As with the brackets 7 installed on the far longitudinal bulkhead, the new brackets 7 should be fitted with cutouts 82 to allow the passage and support of the inner bottom longitudinals 26.

Figure 11A:
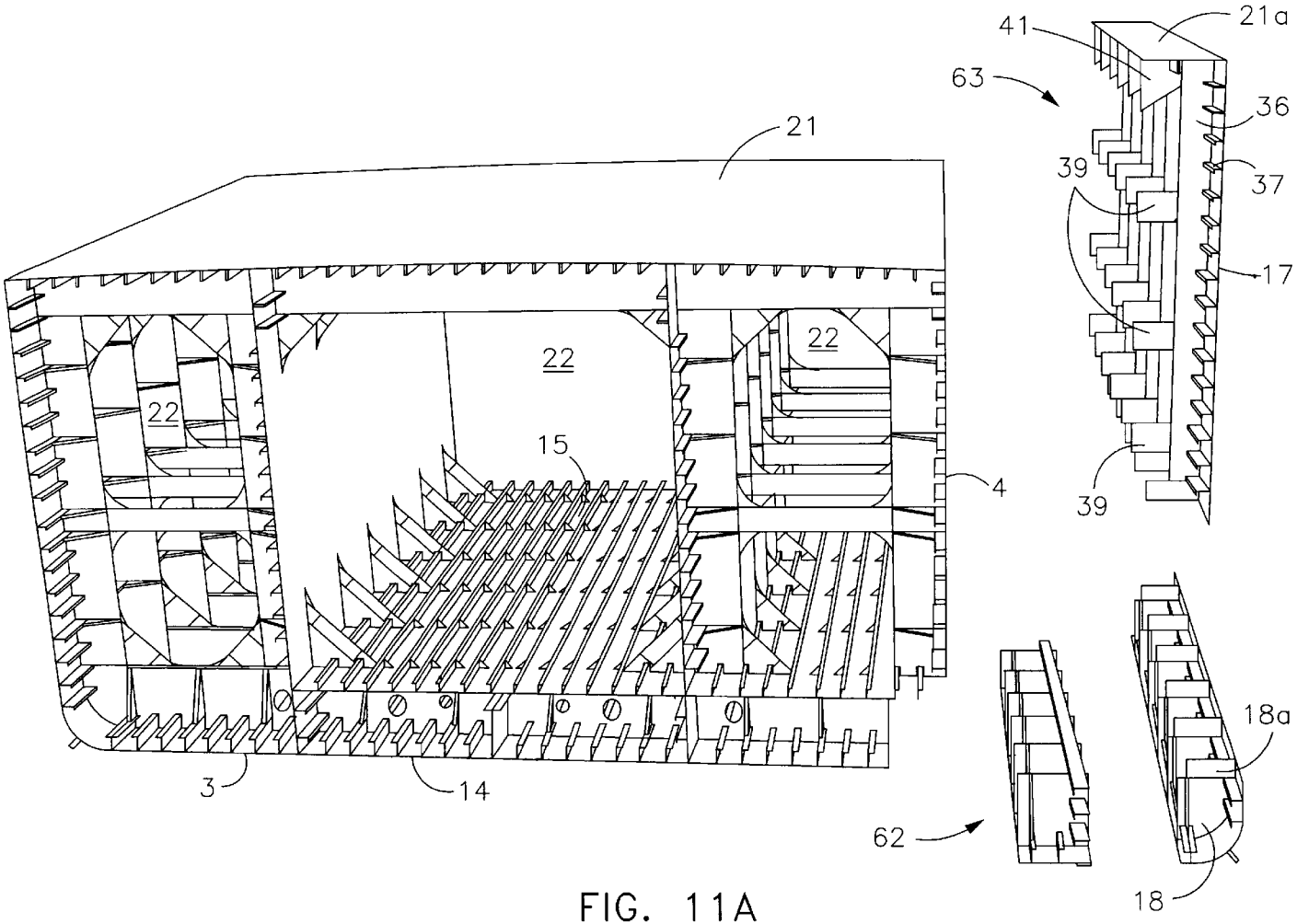
FIGS. 11A–11C show the installation of the new bottom pieces, reinstallation of the turn of the bilge, and installation of the new outer side shell.
Figure 11B:
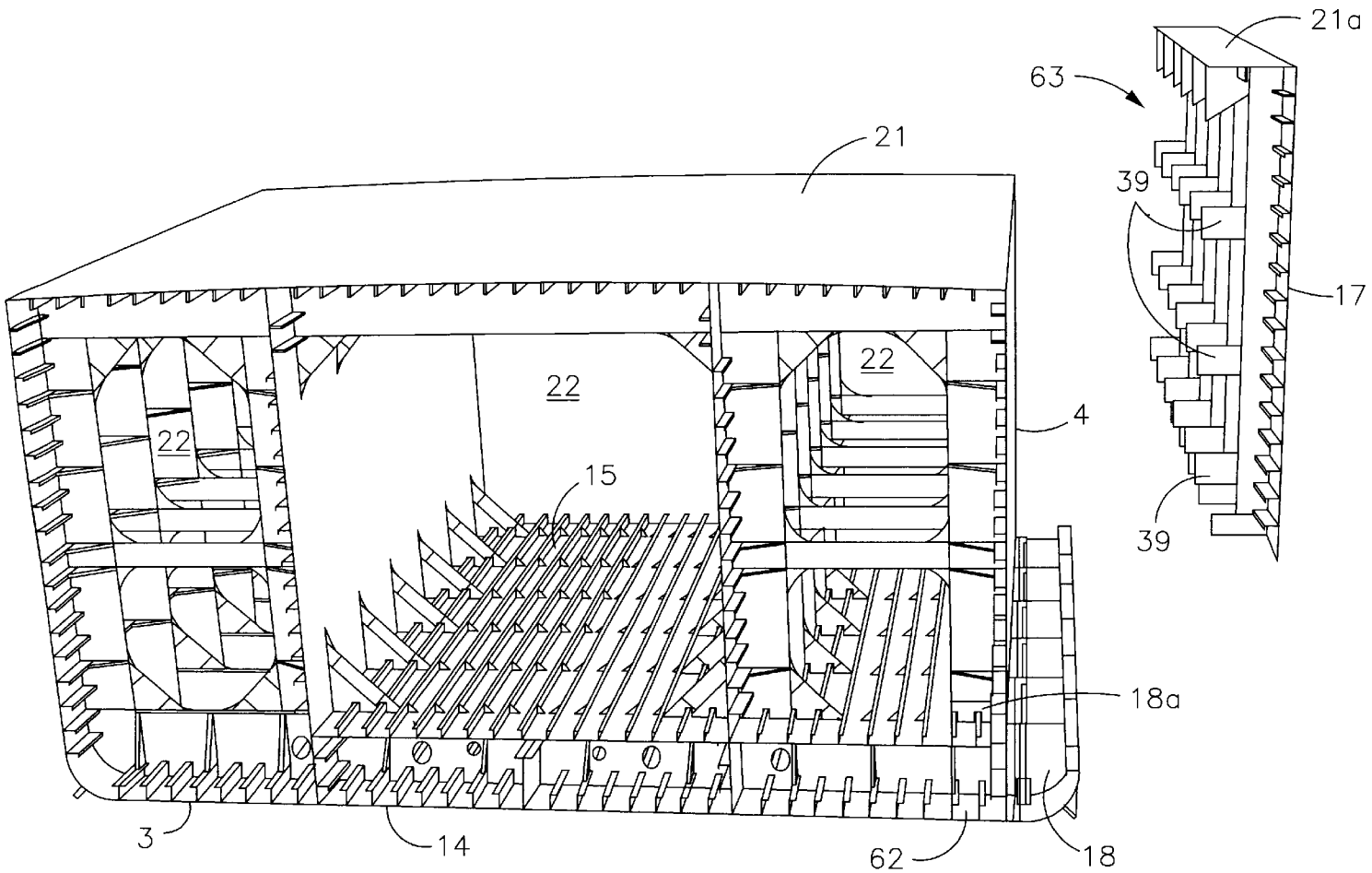

FIGS. 11A and 11B show the installation of the new bottom filler piece 62. New bottom filler piece 62 includes plating and associated transverse and longitudinal stiffening members. This piece will be scribed in such that it matches the existing vessel's bottom plating, including any dead rise, and is directly supporting the former side shell 4 which has become the new longitudinal bulkhead between the cargo and the ballast tanks. After the bottom filler piece 62 is fit up to the existing structure it will be welded out such that the turn of the bilge 18 can be reinstalled.

Figure 11C:
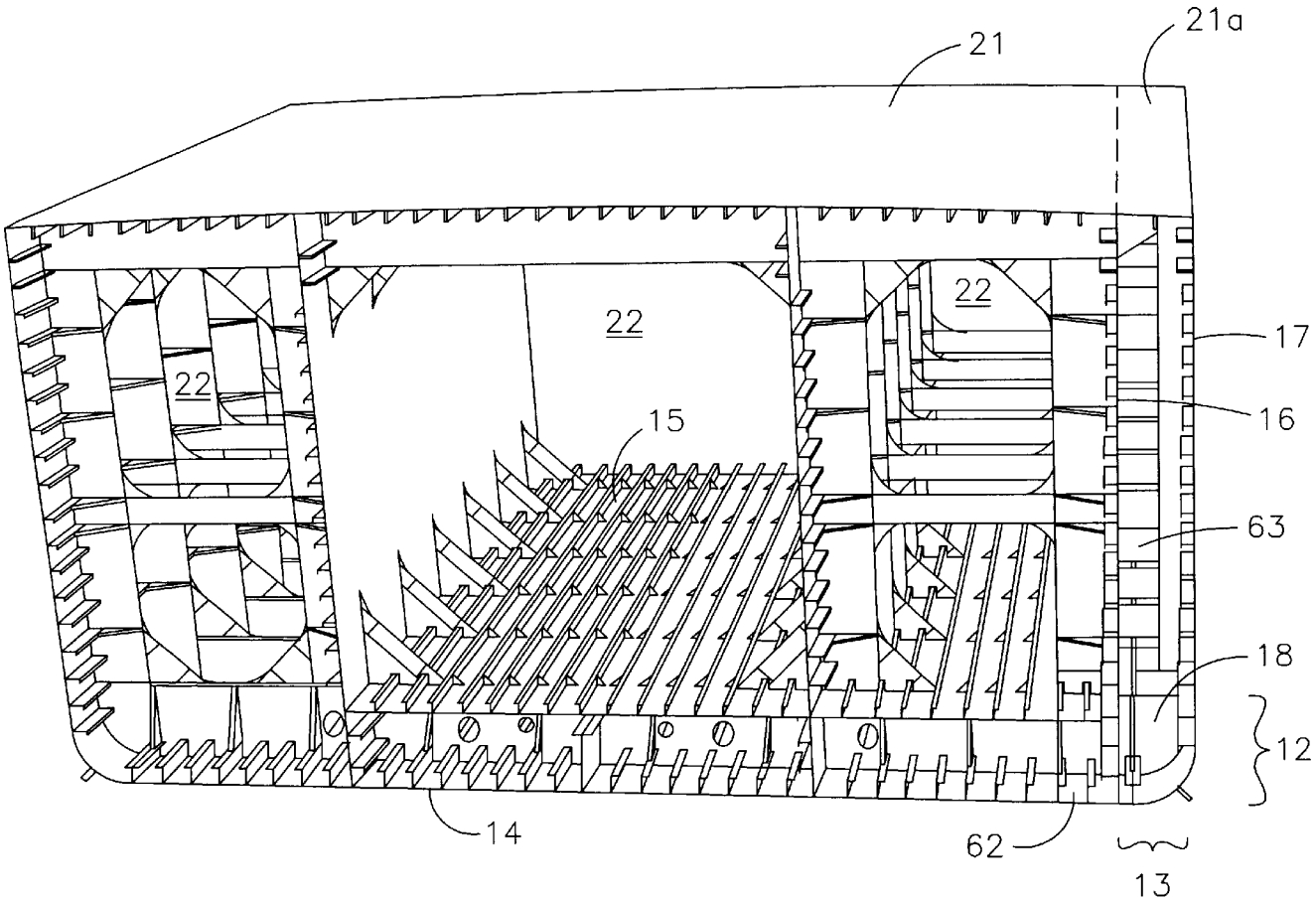

FIGS. 11A–11C illustrate an exemplary process of installing the new outer side hull 17 to the exterior of the existing side shell 4, which forms the existing inner side hull 16. As shown, the original turn of the bilge 18 is scribed in and fit up to the newly inserted bottom filler piece 62. An insert 18*a* is used to close-up the access holes 80 in the inner side hull 16. Preferably, the insert comprises the portion of the outer side shell 18*a* that was removed above the turn of the bilge 18 or, alternatively, new steel may be installed in way of the access hole 80.

As shown in FIG. 11B, once the turn of the bilge 18 is in place the new outer side filler piece 63 and the turn of the bilge 18 must be scribed and fit-up for a good fit at the new outer side shell 17 and the frames. The new outer side filler piece 63 includes the new outer side hull plating 35, connecting plates 39, and transverse and longitudinal stiffeners 36, 37.

FIG. 11C shows the new outer side filler piece 63 and outer side hull 17 connected over the exterior of the existing side shell 4, which again forms the existing inner side hull 16 of the new double side hull 13. As shown in FIG. 11C, the outer side filler piece 63 is installed through the use of connecting plates 39.

In one embodiment, the connecting plates 39 are butt into the original side shell 4 in way of a supporting web frame 28. In one embodiment, the connecting plates 39 connect to the new structure by lapping on the face of the new vertical side shell stiffener 36. This butt and lapping technique is preferred because it allows a great deal of latitude in fit up in that the existing and new structure can be offset within a specified range which aids in modular type construction. This technique provides easily accessed on the connection for welding. Another benefit of the connecting plates 39 is that they can be set to dramatically reduce the vertical side shell stiffener span. The span reduction allows the vertical stiffener of the new side pieces 63 to be smaller than the previous vertical side shell stiffener. The main deck can be simply scribed out to match the contour of the shear strake and then fit up and welded out top and bottom.

Once the rebuild of one side of the tanker is completed, the rebuild of the opposite side of the tanker can begin. As explained previously, both sides of the tanker should not be worked at the same time. The process is very similar, the only difference being that the longitudinal bulkhead does not need to be cut. In order to maintain longitudinal structural integrity, it is preferred that the side shell on one side remain intact at all times while the opposite side is being rebuilt. Therefore, one side should be completely finished before work on the other side begins. As was also stated above, it is also preferred that no cargo hold have the next forward or next aft hold being accessed on the same side at the same time. The process is preferably staggered to prevent structural problems. In other embodiments, multiple adjacent cargo hulls can be worked simultaneously provided that adjacent cargo holds are accessed from opposite sides of the tanker.

Figure 12:
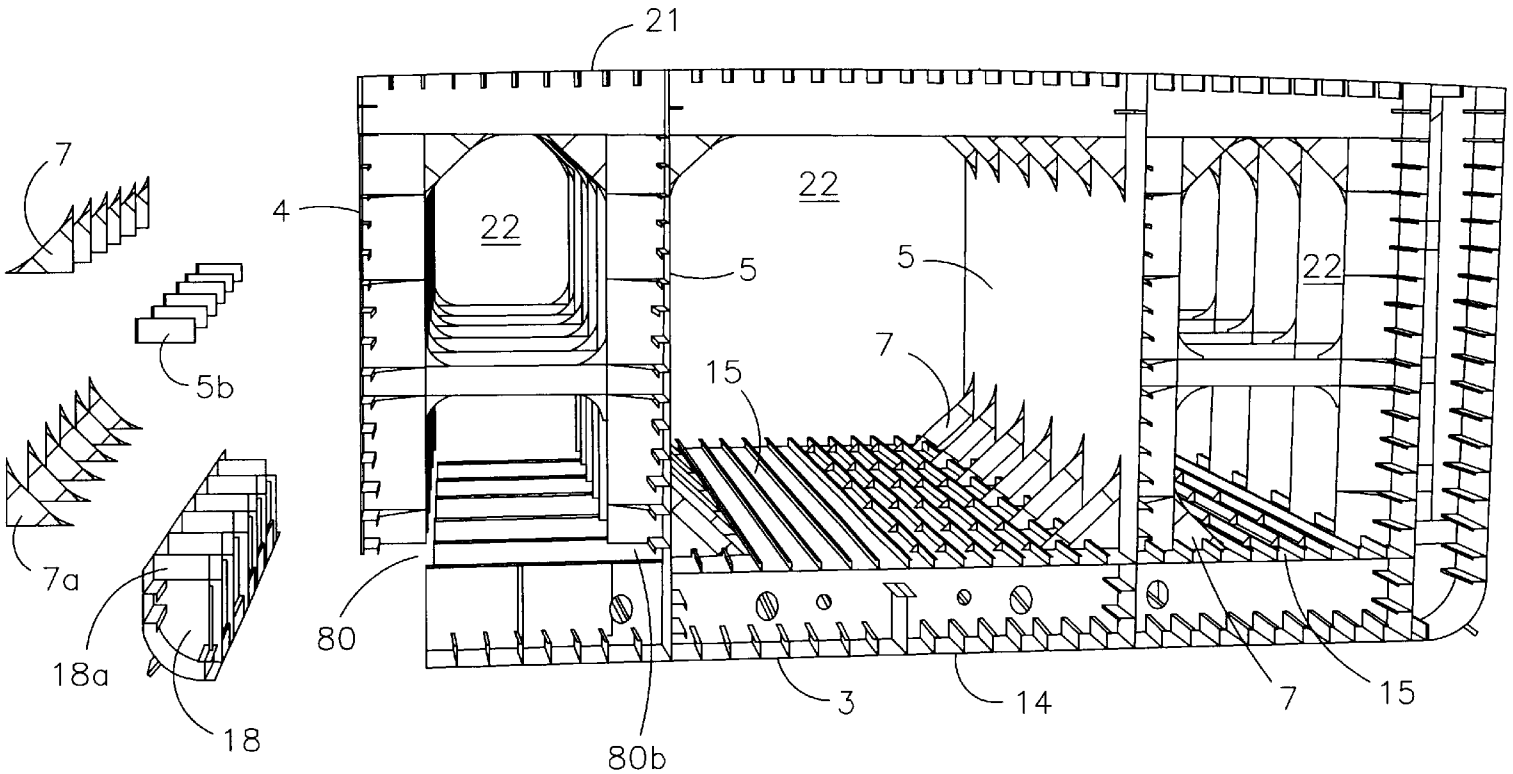
FIG. 12 shows the exemplary tanker of FIG. 8 with the cut-out structure removed from side of the existing single hull to allow installation of the new inner bottom hull.

FIG. 12 shows the tanker rebuild process being performed on the second or opposite side of the tanker. As shown in FIG. 12, the turn of the bilge 18 is removed to form access ports 80. The existing bracketing 7 is then removed through the access ports 80. A lower portion of the longitudinal bulkhead stiffener members 5*b* is removed in way of the inner bottom to form access apertures 80*b* to allow for the installation of the new inner bottom hull 15, including the inner hull plating 25 and stiffeners 26.

Figure 13A:
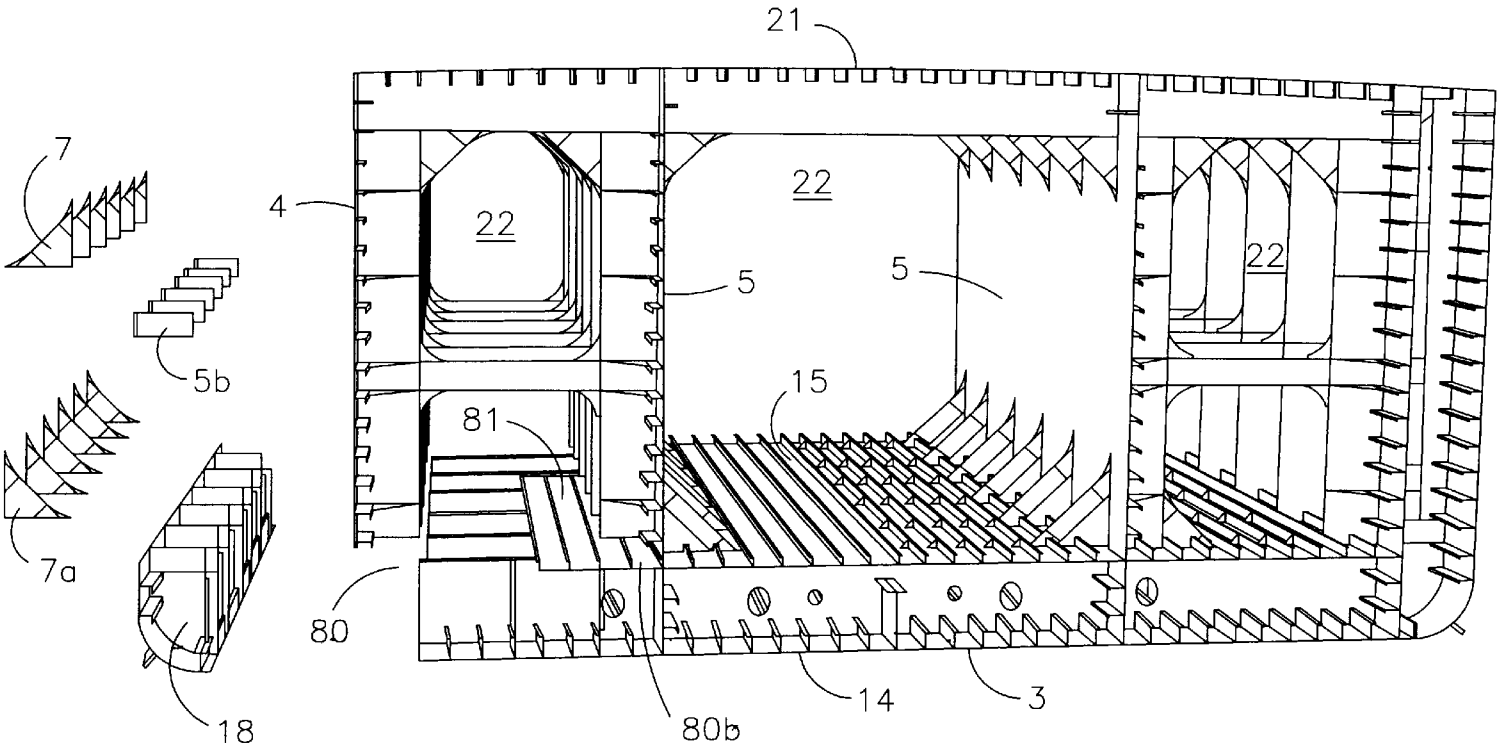
FIGS. 13A–13B show the installation of the new inner hull, the longitudinal bulkhead renewed, and re-installation of support brackets.
Figure 13B:
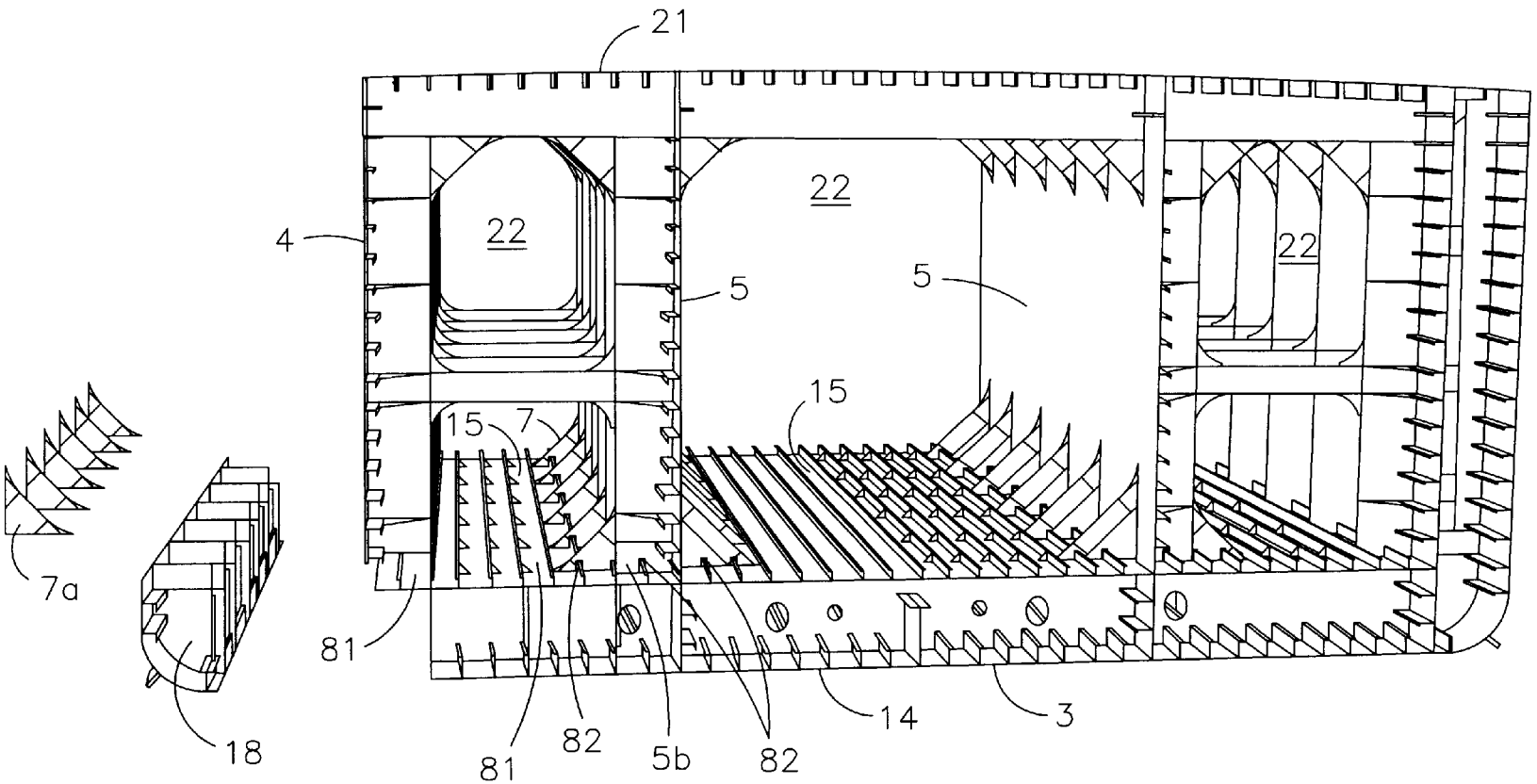

FIGS. 13A and 13B show the installation process on the opposite side. Preferably, the new inner hull 15 is installed as a plurality of plates 81, each having an appropriate size to allow ease of installation and to minimize the amount of welding to attach the plates 81 to the existing structure. FIG. 13B shows the remainder of the new inner bottom hull 15 completely installed and welded out on the second side. The stiffener for the longitudinal bulkhead 5 is renewed. The lower portion of the longitudinal bulkhead stiffener members 5*b* and the brackets 7 should be prepared such that the cutouts 82 are ready and the pieces are ready to be welded out.

Figure 14A:
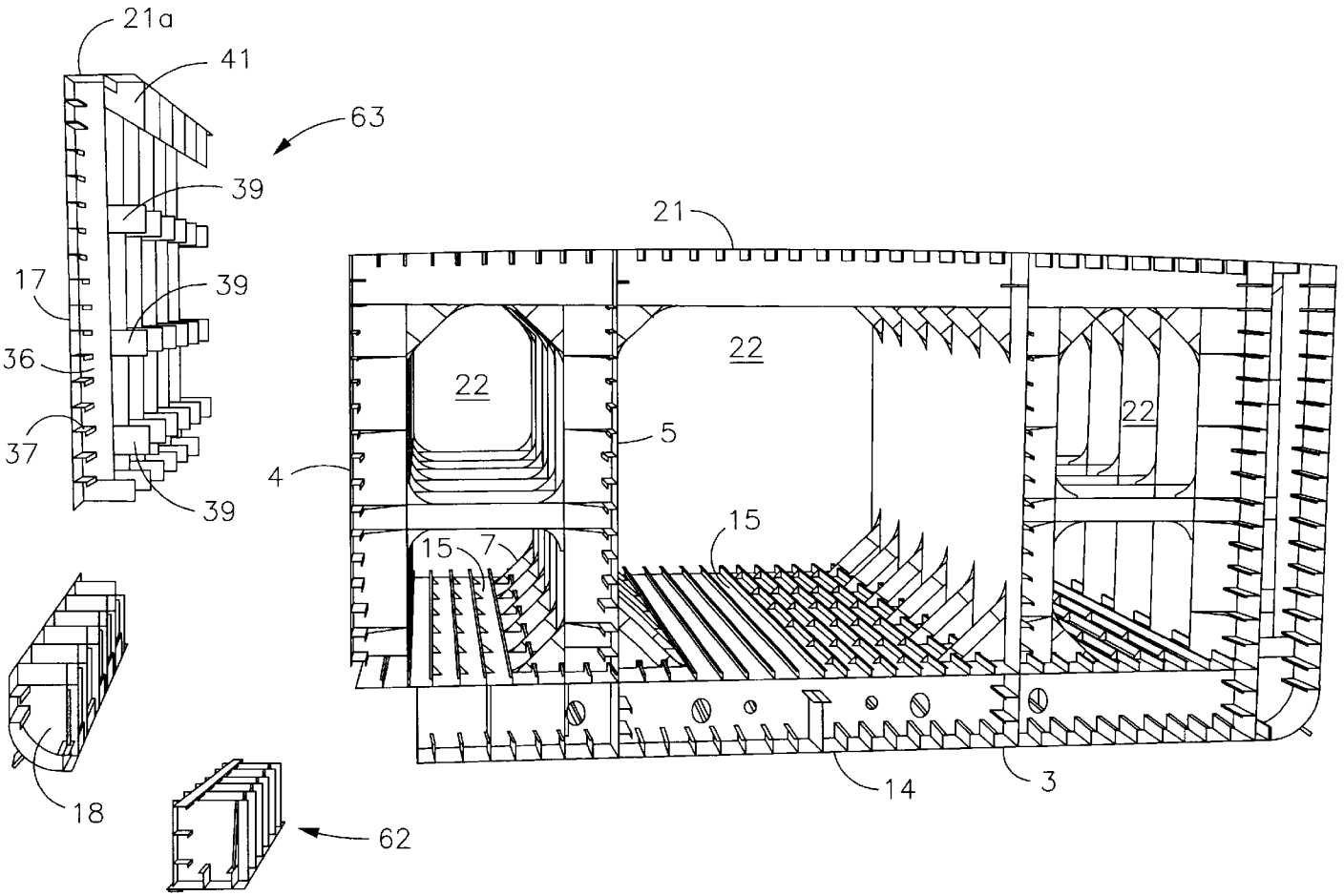
FIGS. 14A–14C show the installation of the new bottom pieces, reinstallation of the turn of the bilge, and installation of the new outer side shell.
Figure 14B:
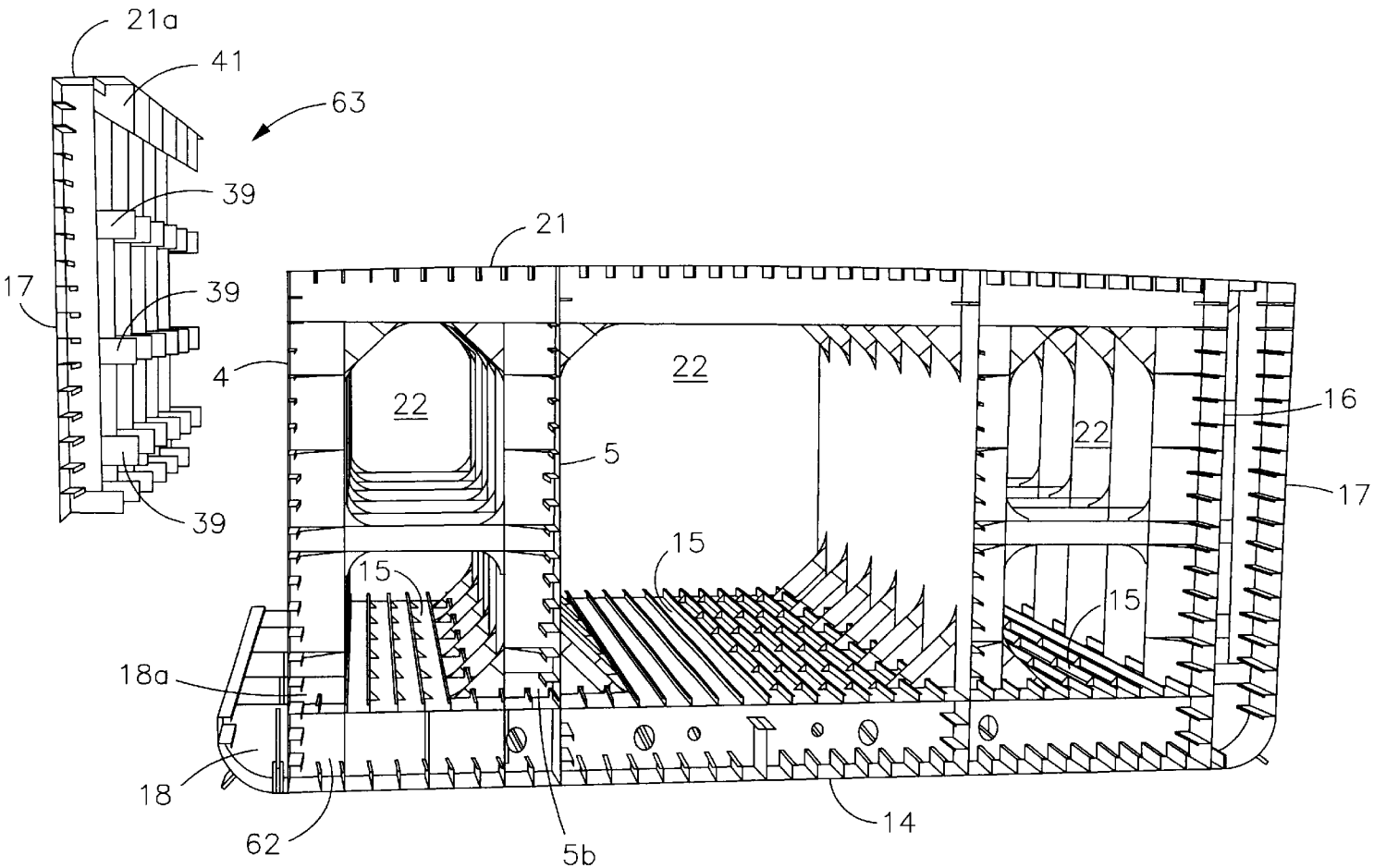
Figure 14C:
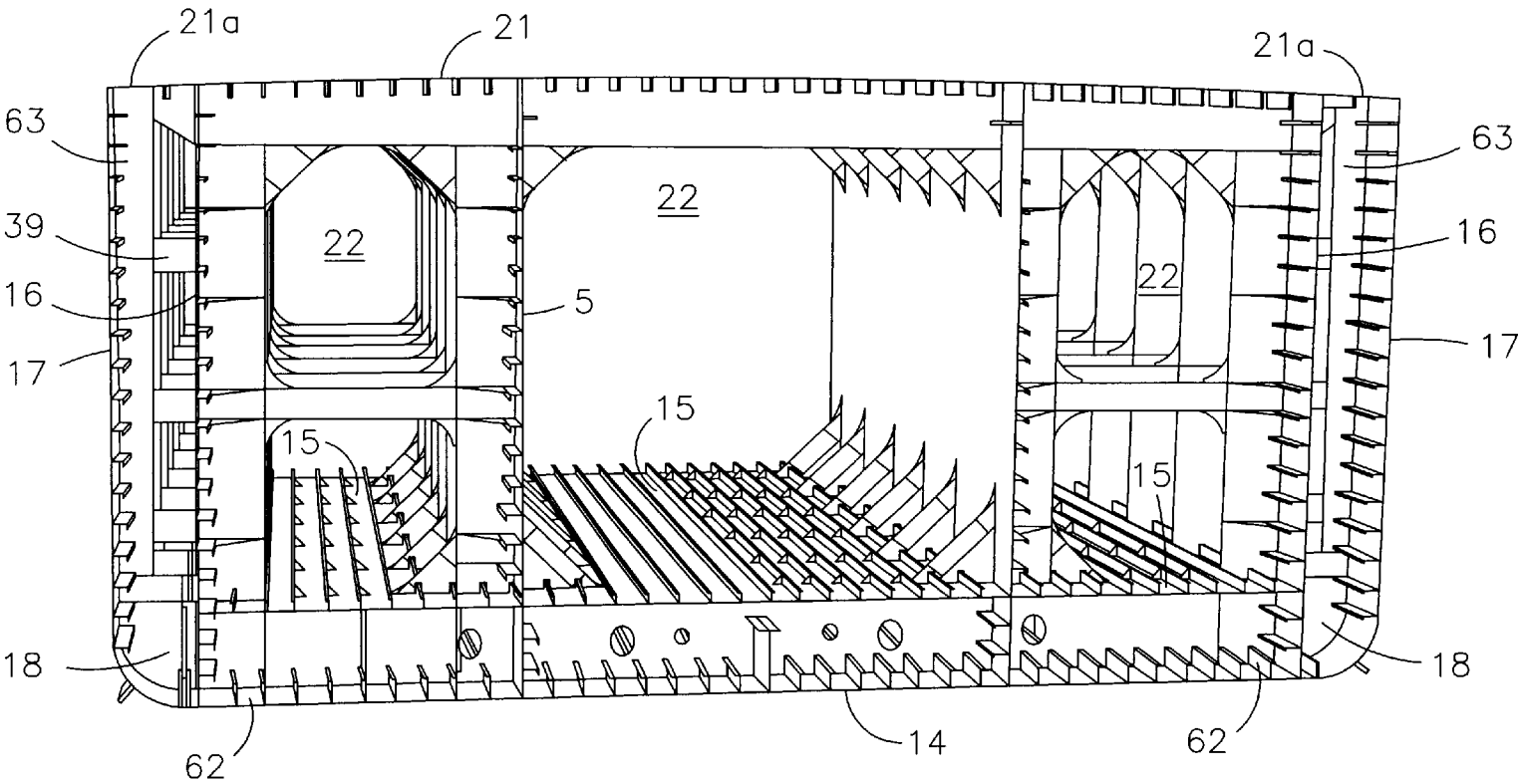

FIG. 14A–14C show the installation of a new bottom filler piece 62, similar to the opposite side, in way of the double bottom hull, reinstallation of the turn of the bilge 18, and installation of the new side filler piece 63. Preferably, the original turn of the bilge 18 is renewed and reinstalled. The new outer side filler piece 63 including outer side hull 17 is landed and welded out as was done on the opposite side. Brackets 7*a* can be scrapped as they are no longer needed in the double hull structure.

Figure 15:
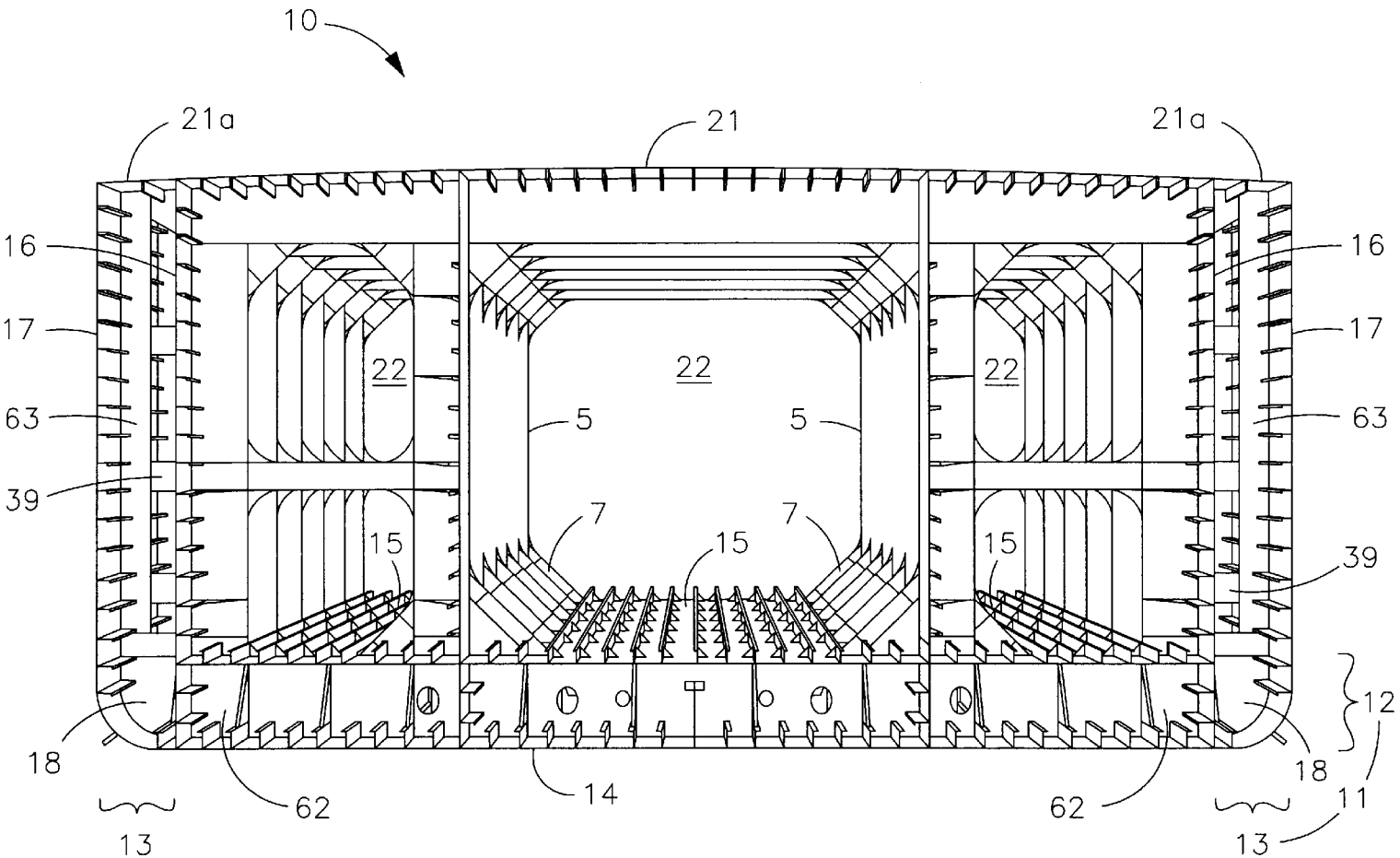
FIG. 15 shows the rebuilt double hull in accordance with one embodiment of the present invention.

FIG. 15 shows the complete section of the rebuilt double hull tanker 10 having a new inner hull 15 over the interior of the existing outer hull 14 to form the new double bottom hull 12 and having a new outer side hull 17 installed over the exterior of the existing inner side hull 16 to form the new double side hull 13. The combination of the new double bottom hull 12 and the new double side hulls 13 form a continuous double hull 11 of the rebuilt tanker 10. The rebuilt double hull tanker 10 is completed and the tanker is ready for service as a double-hulled product carrier.

Advantages and Features of Preferred Embodiments

The process of the present invention provides several enhancements in that all the rebuild work is done from the side and therefore deck machinery and equipment is essentially undisturbed.

Also, the existing ship structure is preferably reused to the maximum extent possible. For example, the inner bottom stiffening members inside the cargo tank 22 preferably takes advantage of the existing transverse members being over two meters high, the existing support brackets are preferably cut, notched, and reused on top of new inner bottom plating, the existing turn of bilge (e.g., the curved side shell plate and bilge keel) is cut, moved outboard and reused, etc. The outer wing tank brackets can be eliminated due to the design of the new double side hulls 13. The method of attaching new outer double side hulls 13 using connecting plates 39 provides for dimensional flexibility during fit-up.

The capacity of the rebuilt tanker 10 can be substantially maintained and/or increased by conversion of the existing ballast tanks to cargo tanks. The draft of the rebuilt tanker 10 can be reduced for the same cargo load through the use of external double sides 13 that result in an increase in buoyancy for the rebuilt tanker 10. The baseline BL of the rebuilt tanker 10 remains substantially the same due to the new double bottom 12 using a new inner bottom hull 15 that is installed internally from the side of the tanker over the existing outer bottom hull 14.

Smoothing hydrodynamic transition fore & aft with elastomer fairing compound.

While the invention has been particularly shown and described with reference to preferred embodiments thereof, it will be understood by those skilled in the art that various alterations in form and detail may be made therein without departing from the spirit and scope of the invention. In particular, the specific shape and size of the tanker, the shape of the transition pieces, the order of installation of the new inner hull sections, the specific number and shape of the filler pieces and plates, and the means for cutting, removing, modifying, and reinstalling the various sections can be altered depending on the specific application without departing from the scope of the invention.

What is claimed is:

1. A double hull tanker rebuilt from an existing single hull tanker comprising:

an inner bottom hull formed from new inner bottom plating;

an outer bottom hull formed from existing outer bottom plating;

a plurality of connecting members disposed between and connecting said new inner bottom hull and said existing outer bottom hull in a spaced apart relationship to form a new double bottom hull;

inner side hulls formed from existing inner side plating;

outer side hulls formed from new outer side plating; and a plurality of connecting members disposed between and connecting said existing inner side hulls and said new outer side hulls in a spaced apart relationship to form new port and starboard double side hulls;

wherein said new double bottom hull and said new double side hulls form a new double hull over at least a cargo carrying portion of said rebuilt double hull tanker.

2. The rebuilt double hull tanker according to claim 1, wherein said plurality of connecting members connecting said new inner bottom hull and said existing outer bottom hull comprise existing web framing, wherein said new inner bottom plating is laid on top of and connected directly to said existing web framing.

3. The rebuilt double hull tanker according to claim 2, wherein said existing web framing further comprises transverse web members.

4. The rebuilt double hull tanker according to claim 1, further comprising a bottom space formed between said new inner bottom hull and said existing outer bottom hull:

wherein said bottom space comprises a distance H between said new inner bottom hull and said existing outer bottom hull measured at right angles;

wherein H is not less than H=beam/15 or 2 meters, whichever is the lesser; and wherein a minimum value of H=1 meter.

5. The rebuilt double hull tanker according to claim 1, wherein said plurality of connecting members connecting said existing inner side hulls and said new outer side hulls comprise new connecting plates connected at a first end to said existing side plating of said existing inner side hull and connected at a second end to said new side plating of said new outer side hull.

6. The rebuilt double hull tanker according to claim 5, wherein said first end of said connecting plates are butt into said existing inner side hull plating in way of an existing supporting web frame and wherein said second end of said connecting plates are lapped on a face of new vertical side shell stiffeners of said new outer side hull.

7. The rebuilt double hull tanker according to claim 1, further comprising side spaces formed between said existing inner side hulls and said new outer side hulls:

wherein a minimum side spacing is based on the deadweight of said tanker and extends either for the full depth of said rebuilt double hull tanker's side or from a top of said double bottom hull to a topside deck;

wherein said minimum side spacing is defined by a distance W which is measured at any cross-section at right angles to said existing inner side hull and defined by W=0.5+deadweight/20,000(m) or 2 meters, whichever is the lesser; and wherein a minimum value of W=1 meter.

8. The rebuilt double hull tanker according to claim 1, further comprising temporary access holes cut into said existing side plating at a location above the turn of the bilge and existing web framing of said existing single hull, wherein said new inner bottom hull is installed through said temporary access holes in said existing side plating over said existing web framing.

9. The rebuilt double hull tanker according to claim 8, wherein said temporary access holes are only cut on either a port side or a starboard side of said tanker at a time and in way of only one adjacent cargo hold at a time and the integrity of the opposite side of said tanker is kept intact to maintain the structural strength of said tanker.

10. The rebuilt double hull tanker according to claim 8, further comprising inserts, wherein said temporary access holes are renewed after said new inner bottom hull is installed with said inserts to close said access holes in said existing side plating.

11. The rebuilt double hull tanker according to claim 10, wherein said inserts comprise portions of said existing inner side hull plating that were cut away to form said temporary access holes in said existing inner side hull.

12. The rebuilt double hull tanker according to claim 8, further comprising temporary access apertures cut into a lower portion of existing longitudinal bulkheads and existing longitudinal bulkhead stiffener members, wherein said new inner hull plating is installed through said temporary access apertures.

13. The rebuilt double hull tanker according to claim 12, further comprising bulkhead inserts, wherein said temporary access apertures in said lower portion of said longitudinal bulkheads are renewed after said new inner bottom hull is installed with said bulkhead inserts to close said temporary access apertures in said lower portion of said existing longitudinal bulkheads and said existing longitudinal bulkhead stiffener members.

14. The rebuilt double hull tanker according to claim 13, wherein said bulkhead inserts comprise said lower portions of said existing longitudinal bulkhead portions that were cut away to form said temporary access apertures.

15. The rebuilt double hull tanker according to claim 1, wherein said rebuilt double hull tanker comprises multiple cargo holds and wherein said new inner bottom hull is installed simultaneously in more than one cargo hold with adjacent cargo holds being worked from alternative port and starboard sides of said tanker to retain structural integrity and sufficient strength during the installation process of said new inner bottom hull.

16. The rebuilt double hull tanker according to claim 1, wherein said rebuilt double hull tanker maintains substantially the same cargo carrying capability as said existing single hull tanker by:

converting one or more existing ballast tanks to cargo tanks; and using a space between one or both of said new inner bottom hull and said new outer bottom hull of said new double bottom hull and said new outer side hulls and said existing inner side hulls of said new side double hulls as new ballast tanks.

17. The rebuilt double hull tanker according to claim 1, wherein said rebuilt double hull tanker reuses substantially all of the existing hull structure.

18. The rebuilt double hull tanker according to claim 1, wherein the draft of said rebuilt double hull tanker is reduced for the same cargo load through the use of said new double side hulls being formed by installing said new outer side hull externally over said existing inner side hull, resulting in an increase in buoyancy for said rebuilt double hull tanker as compared to said existing single hull tanker.

19. The rebuilt double hull tanker according to claim 1, wherein a turn of the bilge and a portion of said existing single hull proximate said turn of the bilge is cut-away to form access holes to allow for installation of said new inner hull, wherein said cut-away portion of said turn of the bilge is reused after installation of said new inner hull.

20. The rebuilt double hull tanker according to claim 19, further comprising new bottom filler pieces connected to each outboard end of said new double bottom hull where said existing turn of the bilge was cut-away and scribed to match said existing outer bottom hull and directly supporting said inner side hulls.

21. The rebuilt double hull tanker according to claim 20, wherein one of said cut-away portions of said turn of the bilges is connected to an outboard end of each of said bottom filler pieces.

22. The rebuilt double hull tanker according to claim 20, further comprising new outer side filler pieces connected over an exterior of said existing port and starboard inner side hulls and connected to said existing turn of the bilges.

23. The rebuilt double hull tanker according to claim 22, further comprising connecting plates for connecting said new outer side filler pieces to said existing inner side hull, wherein said connecting plates are butt into said existing inner side hull in way of a supporting web frame and said connecting plates are connect to the new structure by lapping on a face of new outer side hull stiffeners.

24. The rebuilt double hull tanker according to claim 22, wherein said new outer side filler pieces further comprise new outer portions of topside deck plating that is scribed out to match a contour of the shear strake of existing topside deck plating.

25. The rebuilt double hull tanker according to claim 1, wherein said rebuilt too double hull further comprises:

said existing outer bottom hull plating and said new inner hull plating connected in a spaced-apart relationship by existing transverse web framing to form a central portion of said rebuilt double bottom hull;

new longitudinal stiffener members disposed on a topside of said new inner hull plating;

new bottom filler pieces fitted and connected to an outboard end of said central portion of said rebuilt double bottom hull, said bottom filler pieces having a width substantially equal to a width of said new double side hulls;

existing port and starboard turn of the bilges connected to each outboard end of said new bottom filler pieces; and new side filler pieces fitted and connected to said existing turn of the bilges, said new side filler pieces comprising new outer side hull plating, new connecting plates extending inward from said new outer side hull plating for connection to said existing inner side hull plating, and new port and starboard outer portions of topside deck plating fitted and connected to an outer peripheral edge of existing topside deck plating.

26. The rebuilt double hull tanker according to claim 25, wherein one or more of said new inner bottom hull, said new bottom filler pieces, and said new side filler pieces are prefabricated.

27. The rebuilt double hull tanker according to claim 1, wherein existing topside deck plating, machinery, and equipment is substantially undisturbed during said double hull rebuild.

28. The rebuilt double hull tanker according to claim 1, wherein said new inner bottom plating further comprises a plurality of longitudinal stiffening members extending from a topside of said new inner bottom plating, and wherein a bottom side surface of said inner bottom plating is connected directly to said plurality of connecting members.

29. The rebuilt double hull tanker according to claim 28, wherein existing brackets between existing longitudinal bulkheads and sad existing transverse framing members are cut out for installation of said new inner bottom plating, notched to form cutouts to accommodate said plurality of longitudinal stiffening members extending upward from said new inner bottom plating, and re-installed between said new inner bottom plating and said existing longitudinal bulkheads.

30. The rebuilt double hull tanker according claim 1, wherein existing outer wing tank brackets between existing outer wing tanks and existing transverse framing is cut out and removed, and stiffening of said existing wing tanks is provided by said new double side hulls.

31. The rebuilt double hull tanker according to claim 1, further comprising faired sections formed between said new double side hulls and said existing side hull of said single hull, wherein said faired sections provide a relatively smooth transition between said new outer side hulls and said outer hull of said existing single hull proximate a bow section and a stern section for a smoothing hydrodynamic transition fore and aft in the area where said new double side hull and said existing single side hull meet.

32. The rebuilt double hull tanker according to claim 31, wherein said faired sections partially comprise an elastomer fairing compound.

33. The rebuilt double hull tanker according to claim 1, wherein said rebuilt double hull tanker has an increased cargo carrying capability as compared to said existing single hull tanker.

34. The rebuilt double hull tanker according to claim 1, wherein said rebuilt double hull tanker has a reduced draft at the same cargo capacity as compared to said existing single hull tanker.

35. The rebuilt double hull tanker according to claim 1, wherein said rebuilt double hull tanker has an increased beam due to the installation of said new double side hulls externally over said existing inner side hulls resulting in a greater displacement at the same draft for said rebuilt double hull tanker as compared to said existing single hull tanker.

36. A method of rebuilding an existing single hull tanker into double hull tanker having an internally rebuilt double bottom and externally rebuilt double sides, said method comprising:

cutting out a section of the turn of the bilge on one side of said tanker, including at least a portion of a side shell of said existing single hull above existing web framing to form access holes in said side shell, wherein said cut-out section of said turn of the bilge covers one cargo hold;

cutting out a lower portion of one or more longitudinal bulkheads proximate said one side above said existing web framing to form access apertures in said longitudinal bulkheads, wherein said cut-out lower portion covers said one cargo hold;

installing a new inner bottom hull in one or more sections from said side of said tanker through said access holes and internally over said existing web framing to cover said cargo hull fore and aft and side to side from a longitudinal bulkhead to said side shell;

connecting said new inner bottom hull to a distal end of said existing web framing so that said new inner bottom hull is in a spaced-apart relationship to said existing outer bottom hull to form a portion of a new double bottom hull;

installing a new bottom filler piece to an outboard end of said portion of said new double bottom hull;

installing bulkhead inserts to close said access apertures in said lower portion of said longitudinal bulkhead;

installing inserts to close said access holes in said side shell;

connecting said turn of the bilge to an outboard end of said bottom filler piece;

installing a new side filler piece including a new outer side hull externally over said existing inner side hull;

connecting said new outer side hull to said existing inner side hull using connecting plates to connect said new outer side hull in a spaced-apart relationship to said existing inner side hull to form a portion of a new double side hull;

connecting said new side filler piece to an upper end of said turn of the bilge;

connecting a new outer portion of topside decking to an outer peripheral edge of existing topside decking;

cutting out a section of said turn of the bilge on an opposite side of said cargo hold, including at least a portion of a side shell of said existing single hull on said opposite side above said existing web framing to form access holes in said side shell on said opposite side, wherein said section of said turn of the bilge covers said one cargo hold;

installing said new inner bottom hull in one or more sections from said opposite side of said tanker through said access holes and internally over said existing web framing to cover said cargo hull fore and aft and side to side from said longitudinal bulkhead to said opposite side shell;

connecting said new inner bottom hull to a distal end of said existing web framing so that said new inner bottom hull is in a spaced-apart relationship to said existing outer bottom hull to form a second portion of a new double bottom hull;

installing a second bottom filler piece to an outboard end of said second portion of said new double bottom hull;

installing an insert to close said access holes in said opposite side shell;

connecting said turn of the bilge to an outboard end of said second bottom filler piece;

installing a new side filler piece including an outer side hull externally over said existing inner side hull of said opposite side and an upper end of said turn of the bilge;

connecting said new outer side hull to said existing inner side hull of said opposite side using connecting plates to connect said new outer side hull in a spaced-apart relationship to said existing inner side hull to form a new double side hull;

connecting said new side filler piece to an upper end of said turn of the bilge;

connecting a new outer portion of topside decking to an outer peripheral edge of existing topside decking; and repeating the above steps for each cargo hold of said tanker.

37. The method according to claim 36, wherein said existing single hull tanker comprises a multiple cargo hold tanker, said method further comprising:

installing said new inner bottom hull simultaneously in more than one cargo hold with adjacent cargo holds being worked from alternative port and starboard sides of said tanker in order to retain structural integrity and sufficient strength during the installation process of by said new inner bottom hull.

38. The method according to claim 36, wherein said method further comprising:

cutting out and removing existing support brackets between said side shell and said web frames and between said longitudinal bulkheads and said web frames;

modifying said brackets to provide cutouts in a lower edge for new longitudinal stiffeners to pass through said brackets; and reinstalling said brackets on top of said new inner bottom hull.

39. The method according to claim 36, wherein said method further comprises renewing and reusing one or more of said existing turn of the bilges and said lower portions of said longitudinal bulkheads.

40. The method according to claim 36, wherein said method further comprises prefabricating one or more of said one or more sections of new inner bottom hull, said new bottom filler pieces, and said new side filler pieces.

41. The method according to claim 36, wherein said method further comprises:

butting said connecting plates into said existing inner side hull in way of a supporting web frame; and lapping said new outer side hull on a face of a new vertical side shell stiffener according to allowable fit up tolerances.

42. The method according to claim 36, wherein said method further comprises installing said new inner bottom hull internally over said existing outer bottom hull so that a baseline of said rebuilt double hull tanker is substantially the same as a baseline of said existing single hull tanker and installing said new outer side hull externally over said existing inner side hull in order to increase a beam of said rebuilt double hull tanker as compared to said existing single hull tanker resulting in an increased buoyancy and decreased draft for the same cargo load.

43. The method according to claim 36, wherein said method further comprises converting one or more ballast tanks of said existing single hull tanker into cargo tanks in order to maintain substantially the same cargo carrying capacity or an increased cargo carrying capacity for said rebuilt double hull tanker as compared to said existing single hull tanker.

44. A method of rebuilding an existing single hull tanker into a rebuilt double hull tanker comprising the steps of:

forming a new double hull comprising a new double bottom hull and new double side hulls over at least the cargo carrying portion of said rebuilt double hull tanker;

internally installing a new inner bottom hull through access holes cut into the sides of the tanker and over an existing outer bottom hull of said existing single hull tanker;

connecting said new inner bottom hull to said existing outer bottom hull in a spaced apart relationship to form said rebuilt tanker having said new double bottom hull having the same baseline as said existing single hull tanker;

externally installing a new outer port side hull over an existing inner port side hull of said existing single hull tanker and externally installing a new outer starboard side hull over an existing inner starboard side hull of said existing single hull tanker; and connecting said new outer port side hull in a spaced apart relationship to said existing inner port side hull and connecting said new outer starboard side hull in a spaced apart relationship to said existing inner starboard side hull to form said rebuilt tanker having a said new double side hulls having an increase beam as compared to said beam of said existing single hull.

* * * * *

UNITED STATES PATENT AND TRADEMARK OFFICE

CERTIFICATE OF CORRECTION

PATENT NO. : 6,708,636 B1
DATED : March 23, 2004
INVENTOR(S) : Thomas R. Hagner

It is certified that error appears in the above-identified patent and that said Letters Patent is hereby corrected as shown below:

Column 17,
Line 43, delete “sad” before “existing”

Column 20,
Line 53, delete “a” before “said”

Signed and Sealed this

Twenty-ninth Day of June, 2004

JON W. DUDAS
*Acting Director of the United States Patent and Trademark Office*